US010544540B2

(12) United States Patent
Lee

(10) Patent No.: US 10,544,540 B2
(45) Date of Patent: Jan. 28, 2020

(54) DRYING MACHINE

(71) Applicant: LG ELECTRONICS INC., Seoul (KR)

(72) Inventor: Sangik Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 733 days.

(21) Appl. No.: 14/989,183

(22) Filed: Jan. 6, 2016

(65) Prior Publication Data

US 2016/0201252 A1 Jul. 14, 2016

(30) Foreign Application Priority Data

Jan. 13, 2015 (KR) ..... 10-2015-0006002

(51) Int. Cl.
*D06F 58/24* (2006.01)

(52) U.S. Cl.
CPC ..... *D06F 58/24* (2013.01)

(58) Field of Classification Search
CPC ..... D06F 58/02; D06F 58/24; D06F 58/20; F26B 5/04
USPC ..... 34/77, 73; 454/85, 93, 121, 198, 148, 454/159–161, 233, 236
See application file for complete search history.

(56) References Cited

U.S. PATENT DOCUMENTS

| | | | | |
|---|---|---|---|---|
| 2008/0189973 | A1 | 8/2008 | Dittmer et al. | |
| 2010/0107703 | A1* | 5/2010 | Hisano | D06F 25/00 68/20 |
| 2014/0165416 | A1* | 6/2014 | Pillot | D06F 58/04 34/82 |

FOREIGN PATENT DOCUMENTS

| | | | | |
|---|---|---|---|---|
| CN | 101581025 | | 11/2009 | |
| CN | 103608511 | | 2/2014 | |
| CN | 103748279 | | 4/2014 | |
| DE | 198 11 962 | | 9/1999 | |
| DE | 19811962 | A1 * | 9/1999 | D06F 39/12 |
| DE | 103 46 107 | | 6/2005 | |
| EP | 0943721 | | 9/1999 | |
| EP | 1 108 811 | | 6/2001 | |

(Continued)

OTHER PUBLICATIONS

Chinese Office Action dated Jul. 5, 2017, issued in Application No. 201510947410.1.

(Continued)

*Primary Examiner* — Kenneth Rinehart
*Assistant Examiner* — Bao D Nguyen
(74) *Attorney, Agent, or Firm* — KED & Associates LLP

(57) ABSTRACT

A drying machine is provided that may include a drum configured to receive items to be dried, an air circulating device that circulates air through the drum, a motor that drives a drying fan for air circulation, a condenser that condenses moisture in circulating air introduced from the drum, a heater that heats the circulating air introduced from the condenser, and a base, which is provided under the drum to support the drum and which may form a lower portion of the drying machine. The air circulating device may include a condensation duct, which may change in structure in order to accommodate different types of condensers based on how the respective condensers perform heat exchange. The base may include a condensation duct mount having a consistent shape and size to accommodate the condensation duct regardless of a shape of the condensation duct.

16 Claims, 18 Drawing Sheets

(56) References Cited

FOREIGN PATENT DOCUMENTS

| | | | |
|---|---|---|---|
| EP | 2 527 528 | | 11/2012 |
| EP | 2 594 689 | | 5/2013 |
| JP | 2014-233364 | | 12/2014 |
| KR | 10-0826537 | B1 | 5/2008 |
| KR | 10-1081091 | B1 | 11/2011 |
| KR | 10-1120902 | B1 | 4/2012 |

OTHER PUBLICATIONS

Australian Office Action dated Sep. 13, 2016 issued in Application No. 2016200030.
European Search Report dated May 30, 2016 issued in Application No. 15200017.0.

* cited by examiner

DRYING MACHINE

CROSS-REFERENCE TO RELATED APPLICATION

This application claims priority under 35 U.S.C. § 119 to Korean Patent Application No. 10-2015-0006002, filed in Korea on Jan. 13, 2015, whose entire disclosure is incorporated herein by reference.

BACKGROUND

1. Field

A drying machine is disclosed herein.

2. Background

A drying machine is an apparatus that removes moisture from items, such as clothes, by supplying hot air to the items. A drying machine may include an electric heater, a gas heater, or a heat pump as a heat source for heating air. Accordingly, drying machines may be classified depending on a kind of heat source the drying machine utilizes.

Drying machines may also be classified depending on a manner in which air flows. An exhaust-type drying machine may remove moisture from clothes and discharge high-temperature and high-humidity air outside. A circulation-type drying machine may reuse high-temperature and high-humidity air by circulating the air without discharging the air outside. The circulation-type drying machine may operate in such a manner as to condense the moisture in the high-temperature and high-humidity air and heat the air for reuse. The circulation-type drying machine may also be referred to as a condensation-type drying machine. For example, condensation-type drying machines may be classified into a water-cooling type drying machine, an air-cooling type drying machine, and a heat pump-type drying machine.

Recently, drying machines that include a combination of an exhaust-type drying machine and a circulation-type drying machine have been developed. Thus, it may not be easy to distinguish an exhaust-type drying machine from a circulation-type drying machine.

Drying machines may also be classified depending on a shape of a container for containing clothes or items to be dried. A drying machine, in which the container has a drum shape and which is rotated about a horizontal axis, may be referred to as a horizontal drum-type drying machine. A drying machine, in which the container has a drum shape and which is rotated about a vertical axis, may be referred to as a vertical drum-type drying machine. A drying machine, in which the container is secured to an inside of a cabinet, may be referred to as a cabinet-type drying machine or a refresher.

Circulation-type drum drying machines are predominantly used in homes. In the past, heater-type drying machines that employ electric heaters as the heat source for air have been extensively used. Recently, heat pump-type drying machines that use a refrigerating cycle have come to be widely used.

A heat pump-type drying machine may perform the same or similar procedures of filtering, condensation, and heating circulating air as a heater-type drying machine. However, there may be differences in manners of heating and condensing between the heat pump-type drying machine and the heater-type drying machine. For example, there may be many differences in the structure of the air circulating unit or device between the heater-type drying machine and the heat pump-type drying machine.

Also, different bases may have to be used due to the difference in the manners of heating and condensing, even if the drying machines may have the same external dimensions. If both the heat pump-type drying machine and the heater-type drying machine need to be manufactured, then bases that have different structures for the respective types of drying machines have to be manufactured and managed. Also, components having different structures may have to be used even to fulfill the same function.

The number of components to be managed in different manners in accordance with the type of drying machine may increase, and thus, may increase production costs. In addition, an increase in the number of different components may make manufacturing and after-sales servicing difficult.

In a circulation-type drying machine, efficiently discharging condensed water may be needed. That is, efficiently discharging condensed water generated in the drying machine from the air circulation unit may be needed.

Condensed water may be generated not only in a condenser but also in any region of an air circulation unit due to a decrease in temperature after the drying machine shuts down. It may not be desirable for the condensed water to be reheated or to flow into a drum or a heating unit or heater.

Thus, there may be a high demand to provide a structure for efficiently removing condensed water, for example, in a circulation-type drying machine and a blower-type drying machine. In the blower-type drying machine, condensed water in a drying fan housing may be directly supplied to a heater due to air flow, and noise may be generated. When a large amount of condensed water is directly supplied to the heater, there may be a concern that reliability of the heater may deteriorate. Thus, there may be a very high demand to prevent condensed water from flowing into the drying fan housing and to prevent condensed water in the drying fan housing from being directly supplied to the heater.

BRIEF DESCRIPTION OF THE DRAWINGS

Embodiments will be described in detail with reference to the following drawings in which like reference numerals refer to like elements, and wherein.

DETAILED DESCRIPTION

Figure 1:
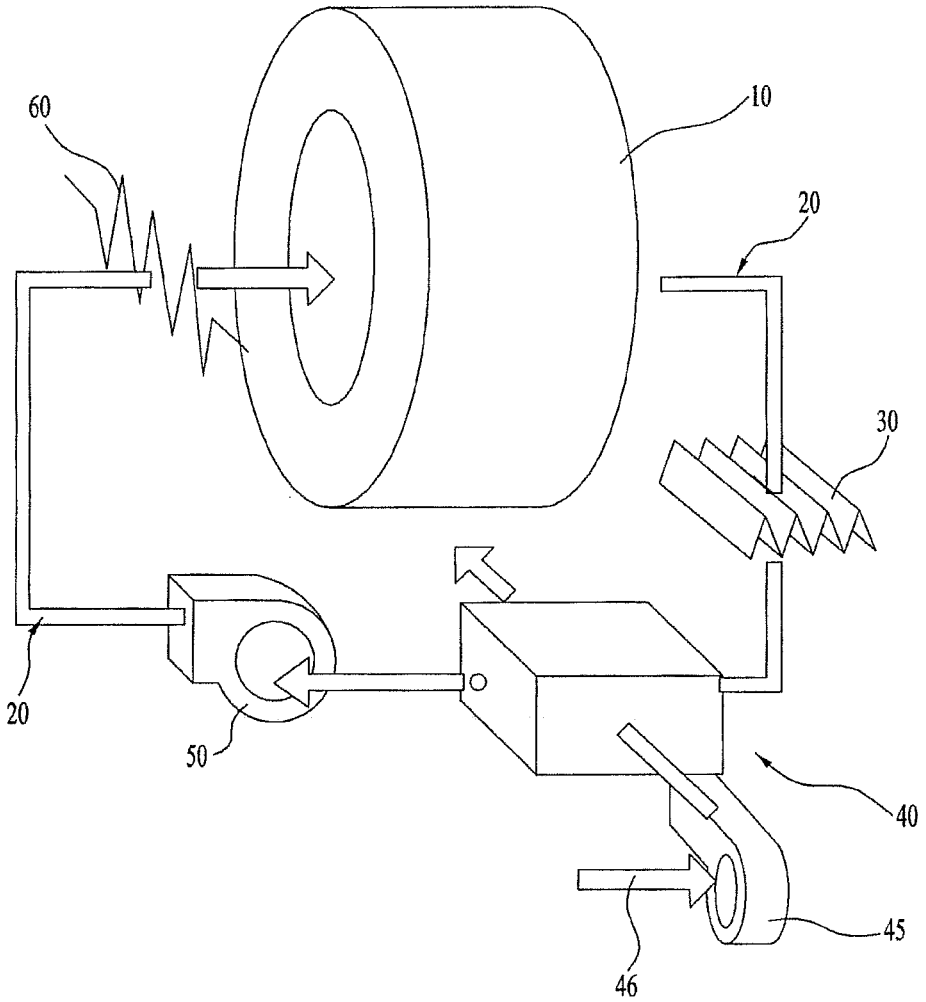
FIG. 1 is a schematic diagram of an air circulation device of a heater-type drying machine according to an embodiment.

FIG. 1 is a schematic diagram of a heater-type drying machine. The heater-type drying machine may include a drum 10 and an air circulation unit or device 20 that circulates air through the drum 10. The air discharged from the drum 10 may flow into the drum 10 again through the air circulation device 20. Thus, the air may be circulated through the air circulation device 20. To circulate the air, a drying fan 50 may be provided. The drying fan 50 may be provided in the air circulation device 20 so as to generate air flow.

The air circulation device 20 may include an additional duct, a portion of which may be formed in a base of the drying machine. The drum 10 may also be referred to as a part or component of the air circulation device 20.

To dry items or clothes in the drum 10, air may be heated via a heater, for example, an electric heater. The heated air may flow into the drum 10 to remove moisture from items or clothes. The air, which may have a high temperature and high humidity due to the removal of moisture, may be discharged from the drum 10 and may flow into a condenser 40. A filter 30 that removes extraneous substances, for example, lint, from the air, may be provided between the drum 10 and the condenser 40. A filter that removes lint in the air may be referred to as a lint filter.

The high-temperature and high-humidity air may be changed into dry air through condensation of moisture in the condenser 40. The high-temperature and high-humidity air may exchange heat with external air that has a lower temperature in the condenser 40. In the course of the heat exchange, moisture contained in the high-temperature and high-humidity air may be condensed and removed.

The condenser 40 may be provided with a cooling fan 45 that introduces and discharges low-temperature external air. The cooling fan 45 may be provided in or at a cooling channel 46. The cooling channel may serve to supply external air to the condenser 40 and may discharge the external air outside of the drying machine. The condenser 40 in the heater-type drying machine may be a structure adapted to allow the air circulation device 20 to intersect with the cooling channel 46.

The low-temperature air discharged from the condenser 40 may be heated by a heating unit or heater 60, and thus, converted into high-temperature dry air. The high-temperature dry air may flow into the drum 10 again. Thus, the air may be circulated through the drum 10, the condenser 40, the drying fan 50, and the heater 60 and may be dried through procedures of heating and condensing the circulating air.

As the drying machine shown in FIG. 1 may be constructed such that air may be blown into the drum 10 from a rear of the drum 10, the drying machine may be referred to as blower-type drying machine. In the drum 10 shown in FIG. 1, a right side of the drum 10 may be a front face and a left side of the drum 10 may be a rear face. Thus, the air for drying items or clothes may flow into the drum 10 from the rear of the drum 10 and may be discharged forward from the drum 10.

Figure 2:
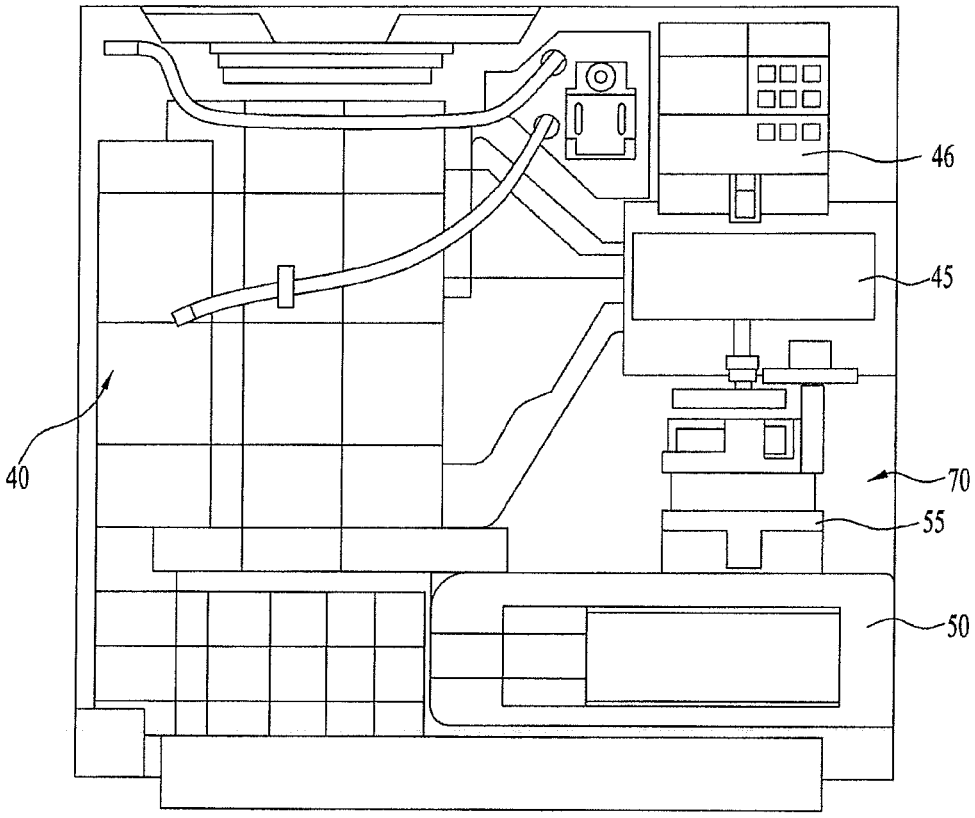
FIG. 2 is a plan view of a base of the heater-type drying machine of FIG. 1 and associated peripheral components.

FIG. 2 is a plan view of a base of the heater-type drying machine of FIG. 1 and associated peripheral components. The drum 10 and the heater 60, which may not be directly mounted on a base 70, are omitted from FIG. 2. An upper side of FIG. 2 may correspond to a rear side of the drying machine, and a lower side of FIG. 2 may correspond to a front side of the drying machine.

On the base 70, the condenser 40 may be provided at a left side, and the cooling fan 45, a motor 55, and the drying fan 50 may be provided at a right side. The motor 55 may be provided to drive the drying fan 50.

The drying fan 50 may be provided in or at a front of the drying machine and under the drum 10. The drying fan 50 may be provided between the filter 30 and the condenser 40, unlike as shown in FIG. 1. In FIG. 2, as the drying fan 50 may be provided in front of the drum 10 and may draw air into the drum 10, the drying machine may be referred to as a suction-type drying machine. That is, the drying machine may be classified as a suction-type drying machine and a blower-type drying machine depending on a positional relationship between the drum 10 and the drying fan 50, for example, depending on whether the drying fan 50 is provided in front of or behind the drum 10.

The air that has flowed into the drum 10 may be discharged outward through the front side of the drum 10 and may flow downward into the condenser 40. After the air is discharged from the condenser 40, the air may rise and flow into the drum 10 through the rear side of the drum 10. Additional ducts may be provided for the upward and downward movement of the air. The additional ducts may be coupled or connected to the drum 10 and the base 70 so as to constitute the complete air circulation device 20.

The external air may flow into the drying machine through the cooling channel 46 from the rear of the drying machine and may be supplied to the condenser 40. The external air supplied to the condenser 40 may exchange heat with the circulating air in the condenser 40 and then may be discharged laterally from the drying machine. That is, by activating the cooling fan 45, the external air may flow into the condenser 40 through the cooling channel 46 and then may be discharged. To improve efficiency of heat exchange, a flowing direction of the circulating air in the condenser 40 may be perpendicular to a flowing direction of the external air.

Figure 3:
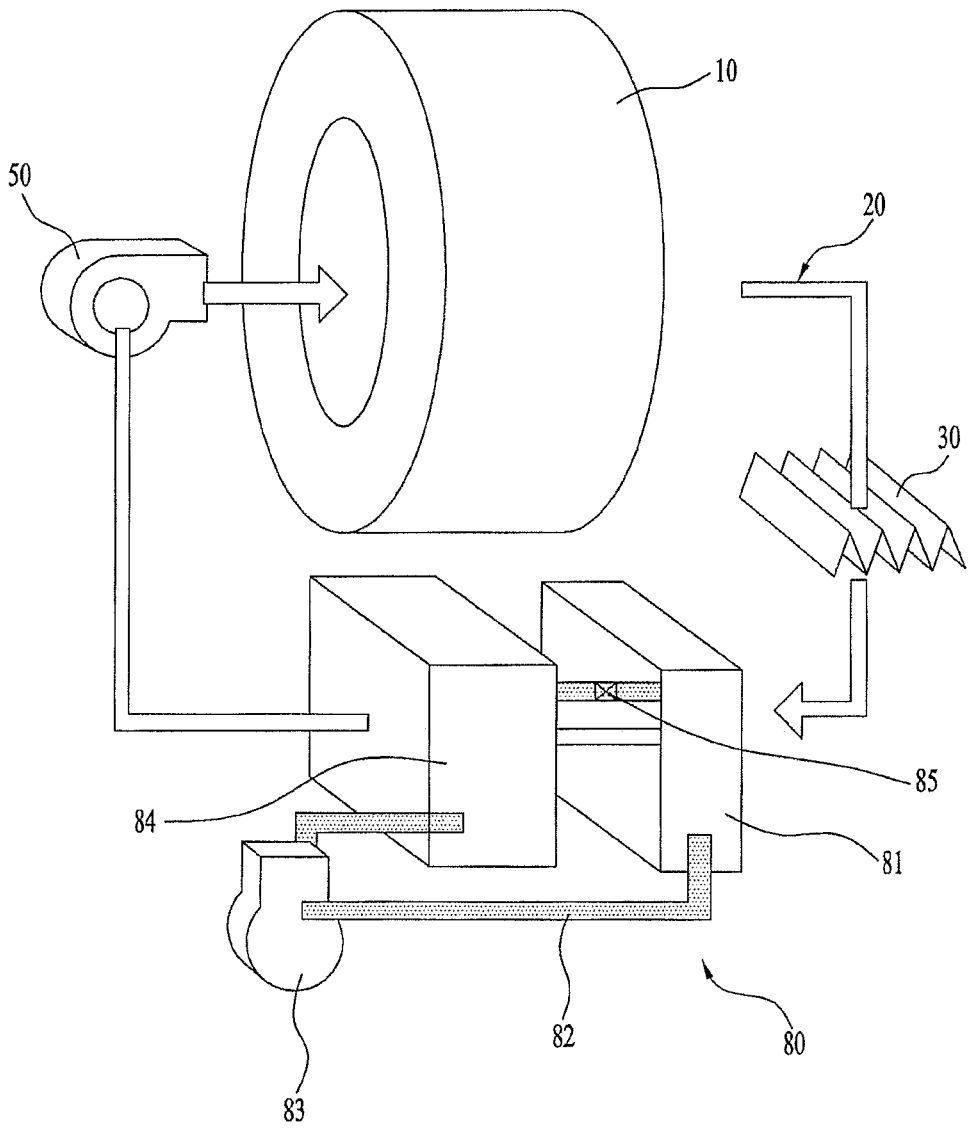
FIG. 3 is a schematic diagram of an air circulation device of a heat pump-type drying machine according to an embodiment.

FIG. 3 is a schematic diagram of an air circulation device of a heat pump-type drying machine according to an embodiment. The heat pump-type drying machine may include a drum 10 and an air circulating unit or device 20 that circulates air through the drum 10. The air discharged through the air circulating device 20 from the drum 10 may flow into the drum 10 again after being subjected to condensation and heating procedures. Thus, the air may be circulated through the air circulating device 20. A drying fan 50 may be provided to circulate air. The drying fan 50 may be provided in the air circulating device 20 to generate air flow.

In order to dry items or clothes in the drum 10, air may be heated and cooled by a heat pump system 80. The heat pump system 80 may be a kind of refrigerating cycle that uses refrigerant. For example, the heat pump system 80 may include a refrigerant pipe 82, an evaporation heat exchanger 81, a compressor 83, a condensation heat exchanger 84, and an expansion member 85.

The refrigerant may be circulated to flow through the refrigerant pipe 82, the evaporation heat exchanger 81, the compressor 83, the condensation heat exchanger 84, and the expansion member 85 in this order. The refrigerant in the evaporation heat exchanger 81 may absorb heat and evaporate. Accordingly, the evaporation heat exchanger 81 may cool circulating air and condense moisture via heat exchange between the refrigerant and the circulating air. The evaporation heat exchanger 81 may be a condenser that corresponds to the condenser 40 of the drying machine in terms of the circulation of air.

The refrigerant in the condensation heat exchanger 84 may be condensed while releasing heat. The condensation heat exchanger 84 may heat the circulating air through heat exchange between the refrigerant and the circulating air. Accordingly, the condensation heat exchanger 84 may a heater that corresponds to the heater 60 of the heater-type drying machine in terms of the circulating air.

Thus, condensing and heating the circulating air may be implemented through the heat pump system 80, and the circulating air may flow into the drum 10 again. A filter 30 that removes extraneous substances, for example, lint, from the air may be provided between the drum 10 and the evaporation heat exchanger 81.

Based on the drum 10 shown in FIG. 3, a right side of FIG. 3 may correspond to a front side of the drying machine, and a left side of FIG. 3 may correspond to a rear side of the drying machine. As the drying machine shown in FIG. 3 may be constructed such that the drying fan 50 may be provided behind the drum 50, the drying machine may be referred to as a blower-type drying machine. However, the drying machine shown in FIG. 4 may be a suction-type drying machine, as described above.

Figure 4:
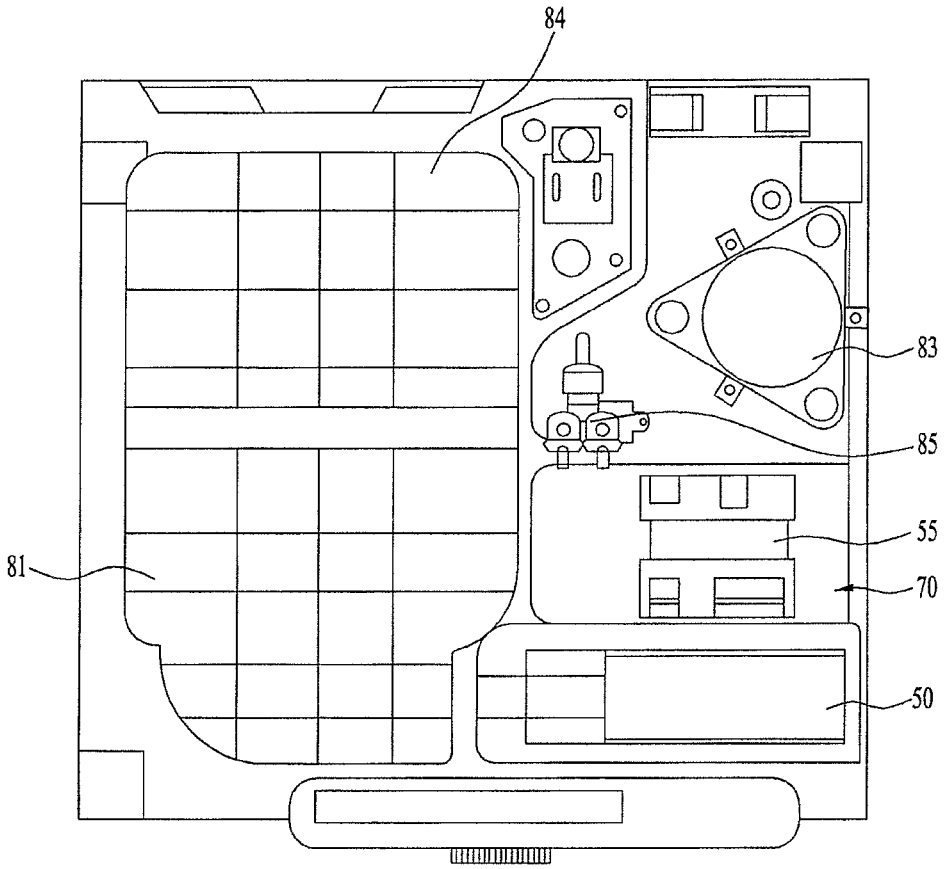
FIG. 4 is a plan view of a base of the heat pump-type drying machine of FIG. 3 and associated peripheral components.

FIG. 4 is a plan view of a base of the heat pump-type drying machine of FIG. 3 and associated peripheral components. The drum 10, which may not be directly mounted on base 70, is omitted from the drawing. On the base 70 shown in FIG. 4, an upper side of the drawing may correspond to a rear side of the drying machine, and a lower side of the drawing may correspond to a front side of the drying machine.

The evaporation heat exchanger 81 and the condensation heat exchanger 84 may be provided at a left side of the base 70. The expansion valve 85, the compressor 83, motor 55, and the drying fan 50 may be provided at a right side of the base 70. The motor 55 may be provided to drive the drying fan 50.

Referring to FIGS. 3 and 4, the air in the drum 10 may be discharged forward from the drum 10 by a suction force of the drying fan 50. The discharged air may flow down toward the evaporation heat exchanger 81 and the condensation heat exchanger 84. The air may be heated and release moisture while passing through the evaporation heat exchanger 81 and the condensation heat exchanger 84. Then, the air may rise and enter the drum 10 through the rear side of the drum 10. As the heat pump-type drying machine may cool and heat air through the heat pump system 80, it may not be necessary to provide the cooling fan 45 or the cooling channel 46, which may be provided in the heater-type drying machine.

The heat pump-type drying machine may perform the same or similar procedures of filtering, condensation, and heating circulating air as in the above-described heater-type drying machine. However, there are differences in manners of heating and condensing between the heat pump-type drying machine and the heater-type drying machine. The heater 50 and the condenser 40 of the heater-type drying machine may correspond to the condensation heat exchanger 84 and the evaporation heat exchanger 84, respectively. As the heater 50 and the condensation heat exchanger 84 may be constructed to heat circulating air, they may be referred to as heating units or heaters.

As described above, the air circulating devices 20 that include the drums 10 in the heater-type drying machine and the heat pump-type drying machine may be substantially identical or similar to each other. The air circulation devices 20 may also have similar drying mechanisms.

However, there may be many differences in the detailed structure of the air circulating device 20 between the heater-type drying machine and the heat pump-type drying machine. The structures of flow channels in the bases 70 may differ from each other due to a difference in manners of heating and condensing. For example, as the flow channel that may form a portion of the air circulating device 20 may be formed in the base 70, there may be no other alternative but to use different bases 70 due to the difference in the flow channel. Thus, different bases 70 may have to be used due to the difference in the manners of heating and condensing, even if the drying machines may have the same external dimensions.

If both the heat pump-type drying machine and the heater-type drying machine need to be manufactured, then bases 70 having different structures for the respective types of drying machines may have to be manufactured and managed. As the bases 70 may have different structures, components mounted on the bases 70 may need to also have different structures. That is, components having different structures may have to be used even to fulfill the same function.

The drying fan 50 and the motor 55 that drives the drying fan 50 may be used in common for both drying machines. Components which may be fundamentally different in manners of heating and condensing may differ from each other. For example, only the heater-type drying machine may include the condenser 40 and the cooling fan 45, and only the heat pump-type drying machine may include the heat pump system 80.

In addition to exclusive components, other components, which may fulfill the same function but may have different structures, may be used in the respective drying machines. Accordingly, the structures of the base 70, the drying fan 50, and other components, for example, a drying fan housing, a condensed water pump, and a condensed water guide member, may vary depending on the kind of drying machine.

For example, among the components that may be directly or indirectly mounted on the base 70 of the drying machines, four components, including the motor 55 and legs, may be used in common in both drying machines. However, twelve components, including the base 70, which may be different from one another, may be used in only one kind of drying machine. Although about seven kinds of components fulfill the same respective functions in both drying machines, the structures of the respective components may be different from each other in both drying machines.

As shown in FIGS. 1 and 2, a drying machine according to embodiments may include the drum 10 that contains items or clothes to be dried, the air circulation device 20 that circulates air through the drum 10, the drying fan 50 for the circulation of air, and the motor 55 that drives the drying fan 50. The drying machine according to embodiments may further include a condenser that condenses moisture in the air introduced from the drum 10, a heating unit or heater that heats the circulating air introduced from the condenser, a condensation duct that contains the condenser, and a base that includes a condensation duct mount on which the condensation duct may be mounted.

The drying machine according to embodiments may include a cabinet that defines an appearance of the drying machine. The base may be provided under the drum so as to support the drum. The base may form a lowermost portion of the drying machine, and the base may be supported on a surface, such as the ground, through legs coupled to the base.

The drying machine according to embodiments may relate to a drying machine that includes a common base. Accordingly, the embodiments may be described based on the base of the drying machine, and a detailed description of components, such as the cabinet and the drum, may be omitted.

Figure 5:
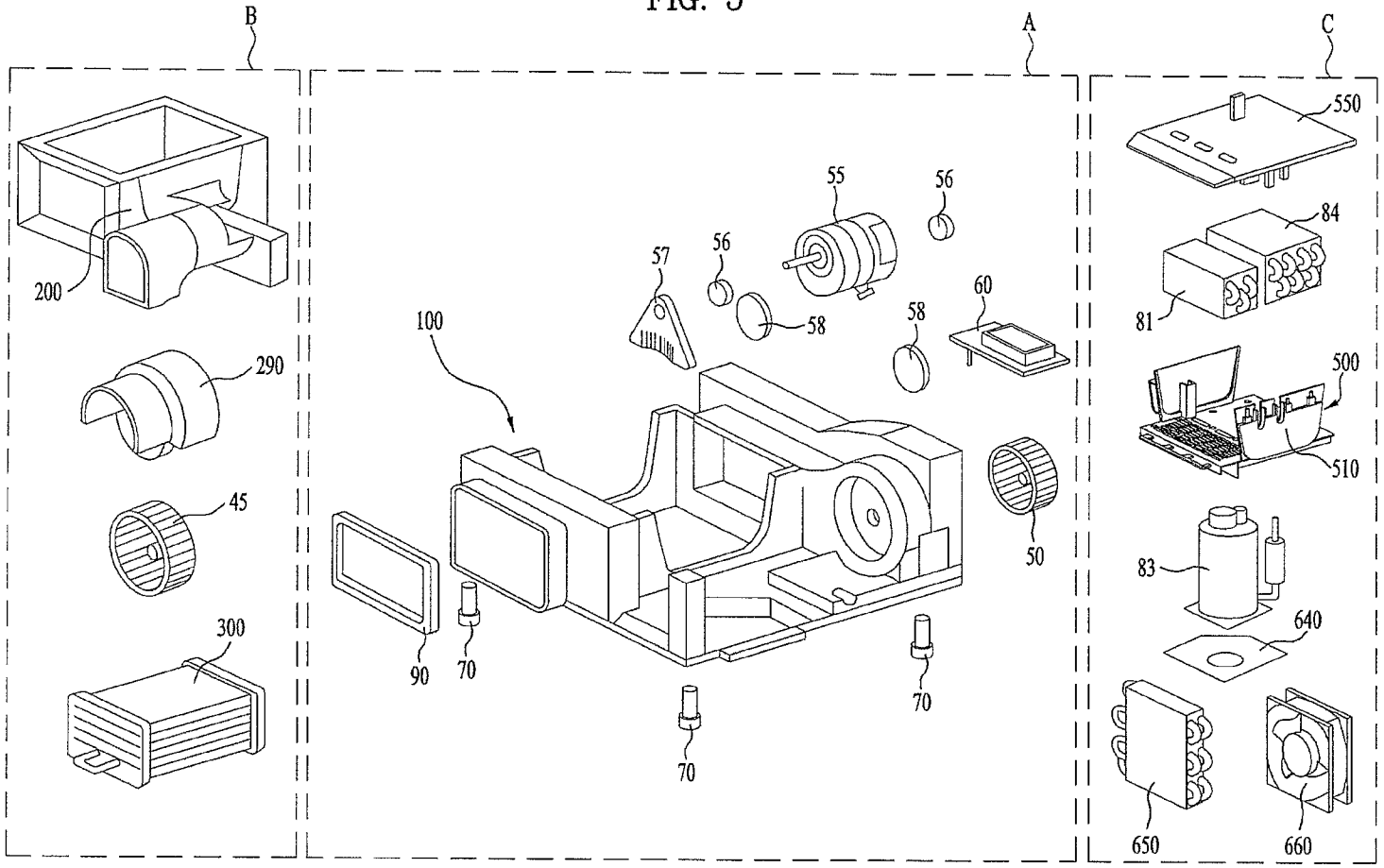
FIG. 5 is an exploded perspective view of a base of a drying machine according to an embodiment and associated peripheral components.

FIG. 5 is an exploded perspective view of a base of a drying machine according to an embodiment and associated peripheral components. FIG. 5 shows a base 100 of the drying machine according to an embodiment, and individual components in a heater-type drying machine and a heat pump-type drying machine. Only components that may be directly or indirectly coupled to the base 100 are shown in FIG. 5.

Components in box A may be components common to both the heater-type drying machine and the heat pump-type drying machine. Components in box B may be components exclusive to the heater-type drying machine. Components in box C may be components exclusive to the heat pump-type drying machine. Accordingly, the components in box A and the components in box B may be coupled to each other to form the heater-type drying machine. The components in box A and the components in box C may be coupled to each other to form the heat pump-type drying machine.

The drying machine according to embodiments may increase a number of the common components through the common base 100. Thus, the number of the exclusive components of the heater-type drying machine and the heat pump-type drying machine, respectively, may decrease.

As the base 100 may be the same in both drying machines, basic components mounted on the base 100 may be common components. For example, components such as, for example, drying fan 50, motor 55 that drives the drying fan 50, a motor shaft coupling member or motor shaft coupler 56, a roller 58 that rotatably supports a drum, a motor shaft bracket 57, a condensed water detection assembly or condensed water detector 65 (shown in FIG. 17), a cover 90, and legs 70 may be common components.

The components in box B, in conjunction with the common components, may form the heater-type drying machine. For example, components such as, for example, a condensation duct 200, cooling fan 45, a cooling fan housing 290, and a condenser 300 may be components exclusive to the heater-type drying machine. The condenser 300 may be a heat exchanger that exchanges heat between circulating air and external air, that is, an air heat exchanger. As the condenser 300 may be used in the heater-type drying machine, the condensation duct 200 may be a condensation duct of the heater-type drying machine, that is, a heater-type condensation duct 200.

The heater 60 that serves as a heating unit or heater to heat air may also be an exclusive component of the heater-type drying machine. However, as the heater 60 may not be mounted on the base 100, it is not shown in FIG. 5.

The components in box C, in conjunction with the common components, may form the heat pump-type drying machine. For example, a condensation duct 500, evaporation heat exchanger 81 that serves as a condenser that condenses moisture in circulating air, condensation heat exchanger 84 that heats circulating air, compressor 83, and a compressor support 640 may be considered exclusive components of the heat pump-type drying machine. In addition, a second fan 660 and a second heat exchanger 650 may be considered exclusive components of the heat pump-type drying machine, as well as refrigerant pipe 82 and expansion unit or expander 85, which may form a refrigerating cycle. The condensation duct 500 may include an upper condensation duct 550 and a lower condensation duct 510. The compressor support 640, the second evaporation heat exchanger 650, and the second fan 660 may also be components exclusive to the heat pump-type drying machine.

The evaporation heat exchanger 81 may also be a condenser. The evaporation heat exchanger 81 may also be a refrigerant heat exchanger in that it may cool refrigerant using air. As the condenser may be used in the heat pump-type drying machine, the condensation duct 500 may be considered a condensation duct of the heat pump-type drying machine, that is, a heat pump-type condensation duct.

Figure 6:
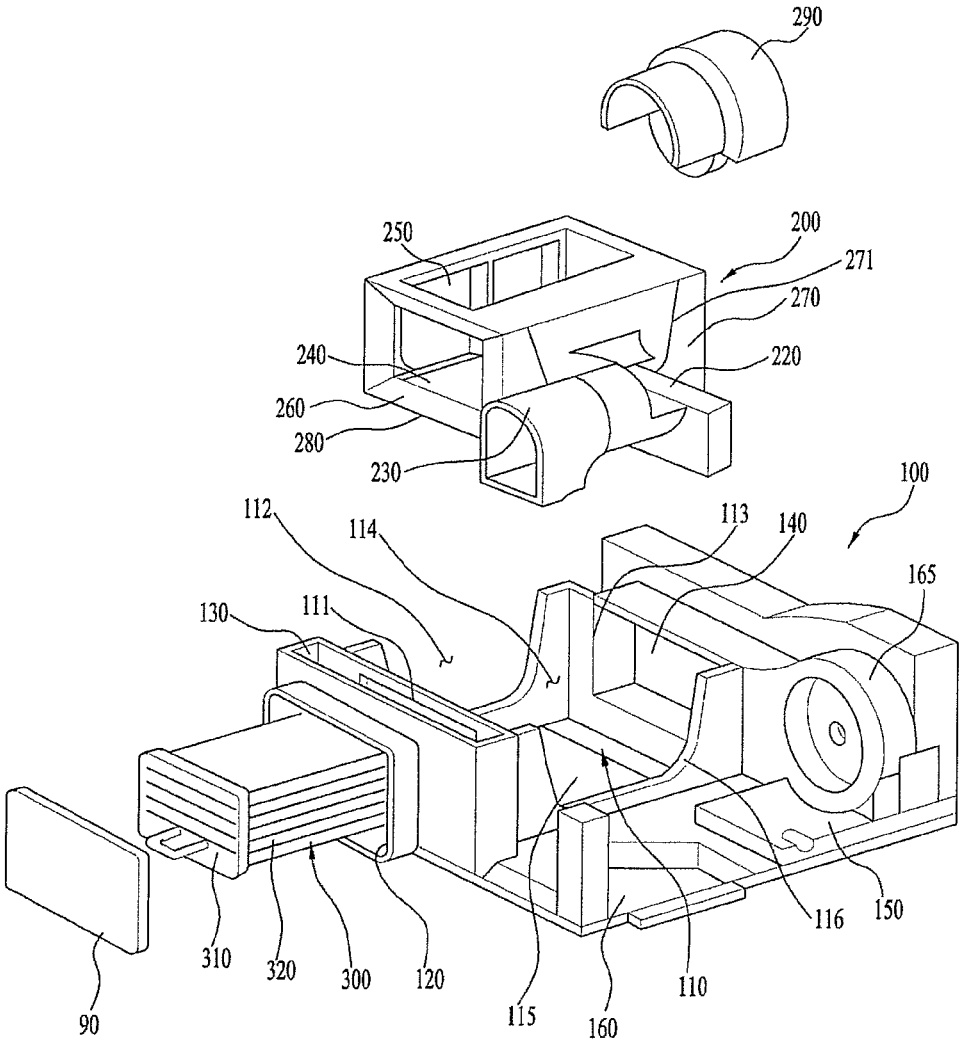
FIG. 6 is an exploded perspective view of a common base and a heater-type drying machine mounted on the base.

As shown in FIG. 6, the common base 100 may be used in the heater-type drying machine and may include the air heat exchanger-type condenser 300, the condensation duct 200, which may accommodate the condenser 300, and the base 100, all of which may be separated from one another.

The base 100 may be provided with a condensation duct mount 110, on which the condensation duct 200 may be mounted. Mounting the condensation duct 200 on the condensation duct mount 110 may define a condensation channel which may serve as a portion of the air circulating device in the base 100.

The condenser 300 shown in FIG. 6 may be of the air heat exchanger-type, that is, the condenser of the heater-type drying machine. The condenser 300 may be provided or received in the condensation duct 200. The condensation duct 200 may be first mounted on the base 100, and the condenser 300 may then be inserted into the condensation duct 200.

The condensation duct 200 may be constructed separately from and independently of the base 100, whereas the condensation duct mount 110 may be constructed together with the base 100 in an integral manner. Thus, even if the condensation duct 200 varies in structure, the base 100 may be used in common.

An opening 120 may be provided at a front end of the base 100. The condensation duct 200 may also be provided at the front end of the base 100 with an opening 260. The opening 120 in the base 100 and the opening 260 in the condensation duct 200 may communicate with each other. For example, the openings 120 and 260 may be aligned with each other. Accordingly, the condenser 300 may be fitted into the condensation duct 200 through the openings 120 and 260 if the condensation duct 200 is mounted on the base 100. After the condenser 300 is mounted on a condenser mount 240 of the condensation duct 200, the opening 120 may be closed by cover 90.

A lint duct 130 may be provided at a front portion of the base 100. The lint duct 130 may form a portion of air circulation device 20. The air discharged forward from the drum may flow into the lint duct 130. The lint duct 130 may be provided with a filter. At least a portion of the lint duct 130 may be integrally formed with the base 100. The lint duct 130 may communicate with the condensation duct mount 110.

The condensation duct mount 110 may have, for example, a regular hexahedral shape or a rectangular parallelepiped shape. A front opening 111 may be provided at a front end of the condensation duct mount 110. The lint duct 130 may communicate with the condensation duct mount 110 through the front opening 111.

A drying duct 140 may be provided at a rear portion of the base 100. The drying duct 140 may form a portion of air circulating device 20 and may form a channel through which air may be supplied to a rear side of the drum.

The condensation duct mount 110 may be provided at a rear end with a rear opening 113 so that the drying duct 140 may communicate with the condensation duct mount 110 through the rear opening 113. The condensation duct mount 110 may be provided at an upper end with an upper opening 114 so that the condensation duct 200 may be mounted on the condensation duct mount 110 from above through the upper opening 114. That is, the upper opening 114 may be an insertion opening through which the condensation duct 200 may be inserted into the condensation duct mount 110. When the condensation duct 200 is mounted on the condensation duct mount 110, the lint duct 130, the condensation duct 200, and the drying duct 140 may communicate with one another through the base 100. The air circulating device may also be sealed from the outside.

High-temperature and high-humidity air from the condensation duct 200 may flow into the condenser 300 through a front inlet 310 of the condenser 300 and then may be discharged. The high-temperature and high-humidity air may exchange heat in the condenser 300. To exchange heat, external air may flow into the condenser 300 through a side inlet 320 and then may be discharged. The circulating air may not contact the external air. For example, the circulating air may intersect with the external air in the condenser 300 and may exchange heat through a heat exchange film.

To introduce the external air, the condensation duct mount 110 may be provided with side openings 112. The side openings 112 may be provided at two lateral sides of the condensation duct mount 110, such that external air may flow into the condensation duct mount 110 through the side openings 112 and may be discharged through the side openings 112.

For example, the condensation duct mount 110 may include a lower mount 115 and side mounts 116. The side mounts 116 may be provided at two lateral sides. The condensation duct 200 may include two side walls 270 and a lower wall 280. The lower wall 280 of the condensation duct 200 may be mounted on the lower mount 115 of the condensation duct mount 110. The side walls 270 of the condensation duct 200 may be coupled to the side mounts 116 of the condensation duct mount 110. For example, the side mounts 116 may be fitted into mounting slots 271 provided in the side walls 270.

A first side wall of the side walls 270 of the condensation duct 200 may be provided with an opening 250, so that external air flowing into the condensation duct 20 may be discharged to the outside. The opening 250 may communicate with one of the side openings 112 in the condensation duct mount 110. Accordingly, one of the side openings 112 may not be closed by the condensation duct 200. The opening 250 may communicate with the side inlet 320 of the condenser 300, but may not communicate with the front inlet 310. Thus, the circulating high-temperature and high-humidity air may not be discharged outside through the side opening 112.

A second of the side walls 270 of the condensation duct 200 may be provided with a cooling fan mount 220. The cooling fan mount 220 may communicate with the condenser 300 through an opening. That is, the cooling fan mount 220 may communicate with the side inlet 320 of the condenser 300. The opening may be configured to have a same or similar shape as that of the opening 250. However, the opening is not visible in FIG. 5 because the opening may be hidden by the cooling fan mount 220.

Cooling fan 45 may be mounted on the cooling fan mount 220, and the cooling fan housing 290 may be coupled to the cooling fan mount 220. An external air guide 230 may be provided in front of the cooling fan mount 220. The external air guide 230 may be connected to an additional duct. The duct may guide external air to the external air guide 230 from a front of the drying machine.

When the cooling fan 45 mounted on the cooling fan mount 220 is operated, external air may flow into the condensation duct 200 through the external air guide 230 and the cooling fan mount 220. The second side wall of the side walls 270 of the condensation duct 200 may close the side mount 116 of the condensation duct mount 110. However, as the second side wall may also be provided with an opening, external air may flow into the condensation duct 200 through the side mount 116 of the condensation duct mount 110.

Accordingly, the condensation duct mount 110 and the condensation duct 200 may define a condensation channel. In addition, a cooling channel may be defined through the side mount 116 and the side opening 112 in the condensation duct mount 110 to allow external air to be discharged. That is, when the condensation duct 200 is mounted on the condensation duct mount 110, the condensation channel and the cooling channel may be defined. For example, by virtue of a shape and positional relationship between the condensation duct 200 and the condensation duct mount 110, the circulating air may intersect the external air in the condensation duct 200.

The side openings 112 in the condensation duct mount 110 may define the cooling channel. That is, when the condensation duct 200 is mounted on the condensation duct mount 110, the cooling channel may be defined through the side openings 112.

As shown in FIG. 6, the side mounts 116 or the side openings 112 may have an inverted trapezoidal shape in which a width of a lower side may be smaller. Angles between the lower side and two lateral sides of the trapezoidal shape may be the same. The angles between the lower side and the two lateral sides of the trapezoidal shape may exceed about 90 degrees but may be equal to or smaller than about 105 degrees.

Assuming that a length between front and rear ends of the condensation duct mount 110 is fixed, increasing the angle between the lower side and the lateral side of the trapezoidal shape may decrease the length of the lower side of the trapezoidal shape. Accordingly, the angle between the lower side and the lateral side of the trapezoidal shape may be limitedly increased while maintaining the trapezoidal shape. This may be because the side openings 112 may define the cooling channel as described above. For example, as the angle is increased, an area of a passage, through which external air may flow into the condensation duct 200 and be discharged, may be decreased. Reducing the area of the passage may mean that a sufficient amount of external air may not be able to flow into the condensation duct 200 and may not be discharged. Thus, the angle may be, for example, smaller than about 105 degrees, and about 100 degrees.

The trapezoidal shape of the side mount 116 or the side opening 112 may make it easy to mount the condensation duct 200. This may be because the condensation duct 200 may be easily mounted by virtue of a weight of the condensation duct 200. As a coupling force between the two components may be maintained by virtue of the weight of the condensation duct 200, it may be advantageous in terms of sealing.

Figure 7:
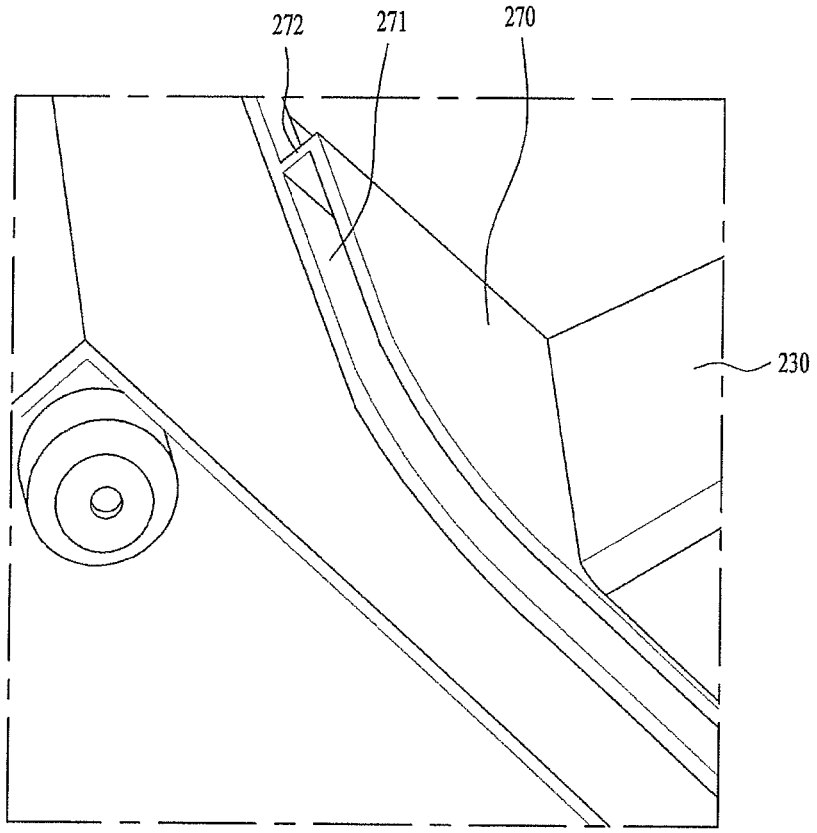
FIG. 7 is an enlarged view of a mounting structure for a condensation duct shown in FIG. 6.
Figure 8:
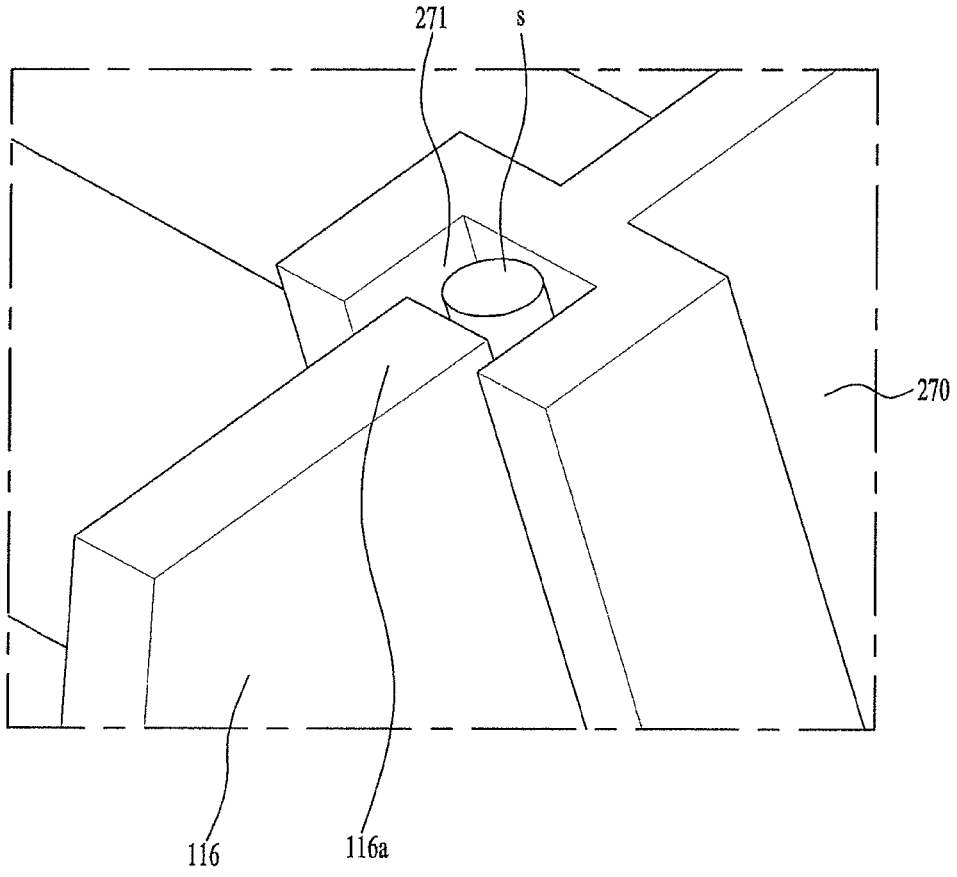
FIG. 8 is an enlarged view of a coupling portion between the condensation duct and a condensation duct mount of the base of the heater-type drying machine, which are shown in FIG. 6.

FIG. 7 is an enlarged view of a mounting structure for a condensation duct shown in FIG. 6. That is, FIG. 7 shows a portion of sidewall 270 of the condensation duct 200. FIG. 8 is an enlarged view of a coupling portion between the condensation duct and a condensation duct mount of the base of the heater-type drying machine, which are shown in FIG. 6. That is, FIG. 8 shows a coupling portion at which the side wall 270 of the condensation duct 200 and the side mount 116 of the condensation duct mount 110 may be coupled to each other.

The mounting slot 271 and a mounting rib 116*a* may be provided between the side wall 270 of the condensation duct 200 and the side mount 116 of the condensation duct mount 110 at a first lateral side of the base 100. The mounting rib 116*a* may be the side mount 116 itself of the condensation duct mount 110. The mounting rib 116*a* may be slidably fitted into the mounting slot 271 and coupled thereto. The mounting slot 271 and the mounting rib 116*a* may also be provided on a second lateral side of the base 100. The mounting arrangement including the mounting slot and the mounting rib may also be provided at or to the condensation duct of a heat pump-type drying machine.

As illustrated in FIGS. 7 and 8, the mounting slot 271 may be provided at or on the side wall 270 and the mounting rib 116*a* may be provided at or on the side mount 116. Unlike the arrangement shown in FIGS. 7 and 8, relative positions of the mounting slot 271 and the mounting rib 116*a* may be reversed. A sealing member s may be provided between the mounting slot 271 and the mounting rib 116*a*. A load of the condensation duct 200 may be applied to the sealing member s. A load of the condenser 300 may also be applied to the sealing member s through the condensation duct 200. Thus, a seal between the condensation duct 200 and the condensation duct mount 110 may be reliably maintained.

The mounting slot 271 may be provided with a stopper 272. The stopper 272 may be provided to limit a coupling position of the condensation duct 200 with respect to the condensation duct mount 110. The condensation duct 200 may drop by its own weight unless the mounting rib 116*a* comes into contact with the stopper 272. Accordingly, the coupling position between the condensation duct 200 and the condensation duct mount 110 may be precisely determined.

The coupling structure between the condensation duct mount 110 and the side wall 270 of the condensation duct 200 may be identically or similarly applied to two lateral sides of the base 100. For example, the mounting slot 271 and the mounting rib 116*a* may be identically and symmetrically provided at the two lateral sides of the base 100.

Thus, the condensation duct 200, which may accommodate the air heat exchanger-type condenser 300, may be coupled to the common base 100, as shown in FIGS. 6 to 8. The condensation duct 500, which may accommodate the refrigerant heat exchanger-type condenser 81, may also be coupled to the common base 100, as shown in FIGS. 9 and 10.

Figure 9:
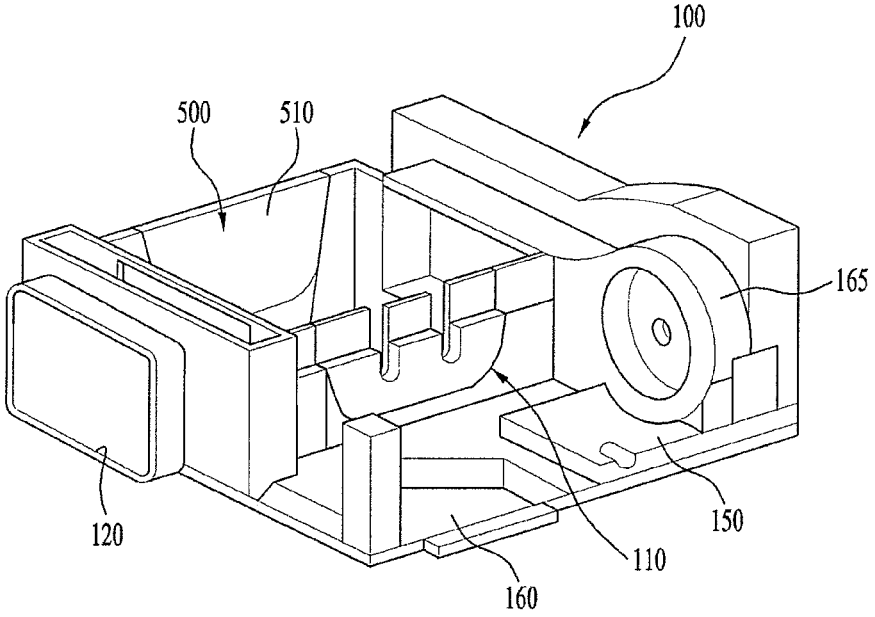
FIG. 9 is an assembled perspective view of the common base and the condensation duct of the heat pump-type drying machine mounted on the base shown in FIG. 6.
Figure 10:
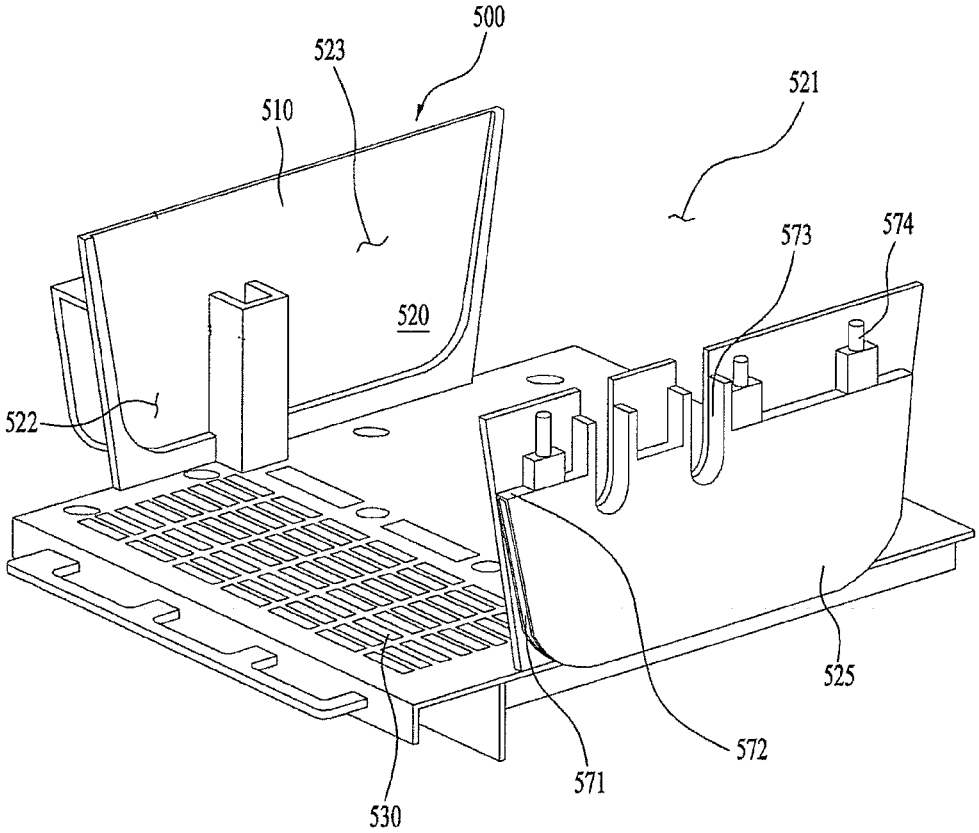
FIG. 10 is a perspective view of a lower condensation duct of the heat pump-type drying machine shown in FIG. 6.

As shown in FIG. 9, common base 100 may be identical to the above-described base 100, on which the air heat exchanger-type condenser 300 may be mounted. That is, the base 100, formed by a single body, may be the same in both cases. The base 100 may be constructed by preparing a plurality of segments and coupling the segments to each other through coupling, for example, thermal fusion.

The base 100 according to this embodiment may include the condensation duct mount 110. The type of the drying machine may be changed depending on which condensation duct is mounted on the condensation duct mount 110. Different types of condensation ducts may be mounted on the same condensation duct mount 110, and the type of drying machine may be changed by changing the condensation duct to be mounted. Even if different condensation ducts are applied, structures of portions of the condensation ducts coupled to the condensation duct mount 110 may be the same.

FIG. 9 is an assembled perspective view of a lower condensation duct of the heat pump-type drying machine shown in FIG. 6. That is, FIG. 9 illustrates an example in which the condensation duct 500 of the heat pump-type drying machine is mounted on the condensation duct mount 110. FIG. 10 is a perspective view of a lower condensation duct of the heat pump-type drying machine shown in FIG. 6. That is, FIG. 10 illustrates the condensation duct 500.

The condensation duct 500 may include lower condensation duct 510, and the lower condensation duct 510 may be mounted on the condensation duct mount 110. The condensation duct 500 may include upper condensation duct 550 shown in FIG. 5. The upper condensation duct 500 may be coupled to the lower condensation duct 510 to define a space to accommodate the condenser.

When the condensation duct 500 is mounted on the condensation duct mount 110, the condensation duct 500 may communicate with the lint duct 130 and the drying duct 140. The condensation duct 500 may specifically accommodate the evaporation heat exchanger 81 and the condensation heat exchanger 84. That is, the evaporation heat exchanger 81 and the condensation heat exchanger 84 may be mounted on a mounting seat 520 provided in the condensation duct 500. The evaporation heat exchanger 81 may serve to cool circulating air and condense the moisture contained in the circulating air. Accordingly, the evaporation heat exchanger 81 may be the condenser of the heat pump-type drying machine. The condensation heat exchanger 84 may serve to heat the air from which moisture may be removed. Accordingly, the evaporation heat exchanger 84 may be the heating unit or heater of the heat pump-type drying machine.

The condensation duct 500, in particular, the lower condensation duct 510, may be provided with an upper opening 523, a front opening 522, and a rear opening 521. The upper opening 523 may be closed by the upper condensation duct 550. The evaporation heat exchanger 81 may be provided or received in the condensation duct 500 near the front opening 522. The condensation heat exchanger 84 may be provided or received in the condensation duct 500 near the rear opening 521. The evaporation heat exchanger 81 and the condensation heat exchanger 84 may be mounted in the mounting seat 520 and may be isolated from each other via a partition.

The mounting seat 520 may be provided with a water-discharging hole 530. For example, the water-discharging hole 530 may be formed in a front portion of the mounting seat 520. The water-discharging hole 530 may include a plurality of water-discharging holes.

The condensed water generated by the evaporation heat exchanger 81 may be discharged downwards through the water-discharging holes 530 and may flow into a sump 66 through a water-discharging channel formed in a bottom surface of the base 100. The sump 66 may be provided with condensed water detection assembly or condensed water detector 65 (shown in FIG. 17).

The condensation duct 500 may include two side walls 525. The two side walls 525 may be provided at the lower condensation duct 510. Each side wall 525 may be provided with a mounting slot 571. The mounting slot 571 may be configured to have a same shape and size as those of the mounting slot 571 of the condensation duct 200 of the heater-type drying machine described above. Accordingly, the condensation duct 500 may be mounted on the same condensation duct mount 110. The condensation duct 500 may also be provided with a stopper 572.

The two side walls 525 may close the two side faces of the condensation duct mount 110 as the heat pump-type drying machine may not need to have the cooling channel. Accordingly, the side openings 112 in the heat pump-type drying machine, which may define the cooling channel in the heater-type drying machine, may be closed by the two side walls 525 of the condensation duct 500.

The coupling structure between the condensation duct mount 110 and the condensation duct 500 may be identical to that of the above-described heater-type drying machine.

A first of the two side walls 525 may be provided with a slot 573. The slot 573 may receive a refrigerant tube. For example, the slot 573 may expose the refrigerant tube, which may be provided at the evaporation heat exchanger 81 or the condensation heat exchanger 84, to the outside. By virtue of the slot 573, the heat exchanger may be firmly secured in the condensation duct. Further, it may be possible to prevent the size of the condensation duct from increasing due to the refrigerant tube.

Each of the two side walls 525 may be provided with a plurality of coupling members 574 that couples the upper condensation duct 550 to the side wall 525. The plurality of coupling members 574 may be modified in various ways.

A motor mount 150 may be provided at a lateral side of the base 100. A drying fan mount 165 may be provided behind the motor mount 150. The base 100 may be provided with a selective mount 160 before the motor mount 150.

The same motor and the same drying fan may be mounted on the motor mount 150 and the drying fan mount 165, respectively, in both types of drying machines. Accordingly, shapes of the motor mount 150 and the drying fan mount 165 may not change, irrespective of the type of drying machine.

The compressor 83 or the cooling fan mount 230 may be mounted on the selective mount 160. For example, the compressor 83 may be mounted on the selective mount 160 in the heat pump-type drying machine, and the cooling fan mount 230 may be mounted on the selective mount 160 in the heater-type drying machine. Thus, the same base may be used for heat pump-type drying machines and heater-type drying machines.

An embodiment of the drying machine having a structure for discharging condensed water will be described hereinafter. This embodiment may be constructed independently of or collectively with the previous embodiments. Components that may be used in common in the previous embodiments may be designated by the same reference numerals, and detailed descriptions thereof have been omitted.

Discharge of condensed water may be important in the drying machine, which may serve to condense moisture in the circulating air. This may influence efficiency of the drying machine and reliability and durability of products. For example, it may be important to minimize the flow of condensed water generated from the air circulating device into the drum or the heater, while efficiently discharging condensed water generated from the condenser to the sump.

The condensed water may not only be generated from or by the condenser during operation of the drying machine, but may also be naturally generated by a temperature drop after the drying machine shuts down. Condensed water generated by the temperature drop may collect in the air circulating device and may flow into the drum or the heater during subsequent operation of the drying machine. Removal of the condensed water, thus, may require additional energy and lower the efficiency of the drying machine.

In the above-described suction-type drying machine, air discharged from the drum may flow into the drying fan. This may be because the drying fan may draw air from the heating unit or heater. Thus, the possibility that condensed water generated near the drying fan may flow into the heating unit or heater may be low. In the blower-type drying machine, the possibility that condensed water generated near the drying fan may be supplied to the heater may be relatively high. This may be because the drying fan may blow air toward the heater.

Although it may be important to remove condensed water in both the suction-type drying machine and the blower-type drying machine, it may be more important to remove condensed water in the blower-type drying machine. The drying machine using the common base previously described, for example, the heater-type drying machine, may be a blower-type drying machine. Thus, it may be very important to remove condensed water in the blower-type drying machine, which may be the heater-type drying machine.

Figure 11:
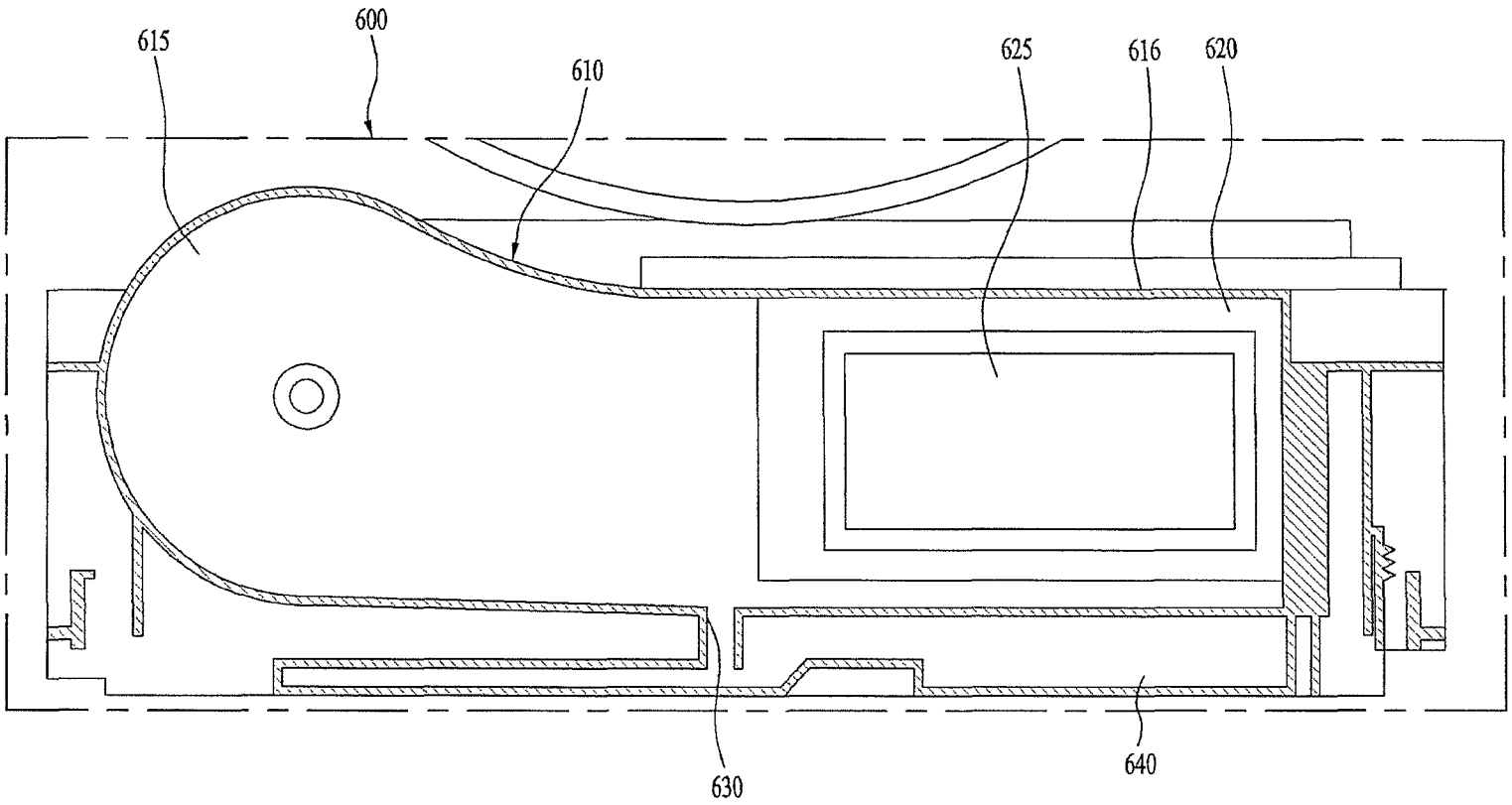
FIG. 11 is a cross-sectional view of a condensed water-discharging structure of a base of a conventional drying machine.

FIG. 11 is a cross-sectional view of a condensed water-discharging structure of a base of a conventional drying machine. That is, FIG. 11 illustrates a structure that discharges condensed water in a base of a conventional drying machine. A first drying duct 610 may be provided at a rear portion of a base 600 of the drying machine. The first drying duct 610 may be provided between a condensation duct 620 and a second drying duct. The condensation duct 620 may contain a condenser 625. As the drying machine operates, condensed water generated from or by the condenser 625 may flow into a sump 640 through a water-discharging channel. The water-discharging channel may be provided at a lower portion of the condenser 625. The water-discharging channel and the sump may be integrally formed with the base.

A first end 616 of the first drying duct 610 may be connected to the condensation duct 620, and a second end of the first drying duct 610 may form a drying fan housing connector 615. The drying fan housing connector 615 may be connected to a drying fan housing. When a drying fan provided at or in the drying fan housing is activated, the drying fan may draw air from the condensation duct 620. Thus, condensed water in the condensation duct 620 may flow into the drying fan housing through the drying fan housing connector 615. The condensed water may be supplied to a heater, which may be provided at or in the second drying duct, through the drying fan housing 615.

In the conventional drying machine, a water-discharging hole 630 may be formed in a bottom of the first drying duct 610 to discharge the condensed water. As the water-discharging hole 630 may be formed in the bottom of the first drying duct 610, upon activation of the drying fan, the condensed water may flow along the bottom surface of the first drying duct 610 and into the water-discharging hole 630.

However, the water-discharging hole 630 may insufficiently discharge condensed water. This may be because most of the condensed water may be drawn into the drying fan due to high suction pressure. In addition, as the difference between a height of an inlet in the water-discharging hole 630 and a height of the sump 640 may not be great, the structure may also cause condensed water to insufficiently discharge from the water-discharging hole 630.

According to this embodiment, it may possible to provide a drying machine having a structure capable of discharging condensed water more efficiently. For example, the condensed water-discharging structure may be integrally formed with the base, thereby offering a drying machine capable of being easily assembled. In addition, this embodiment may be constructed in conjunction with the previous embodiment to provide a drying machine having the condensed water-discharging structure or used together regardless of the type of drying machine.

According to this embodiment, it may be possible to provide a drying machine having a condensed water-discharging structure capable of efficiently preventing condensed water generated from the air circulating device from flowing into the drum along the air circulating device.

Figure 12:
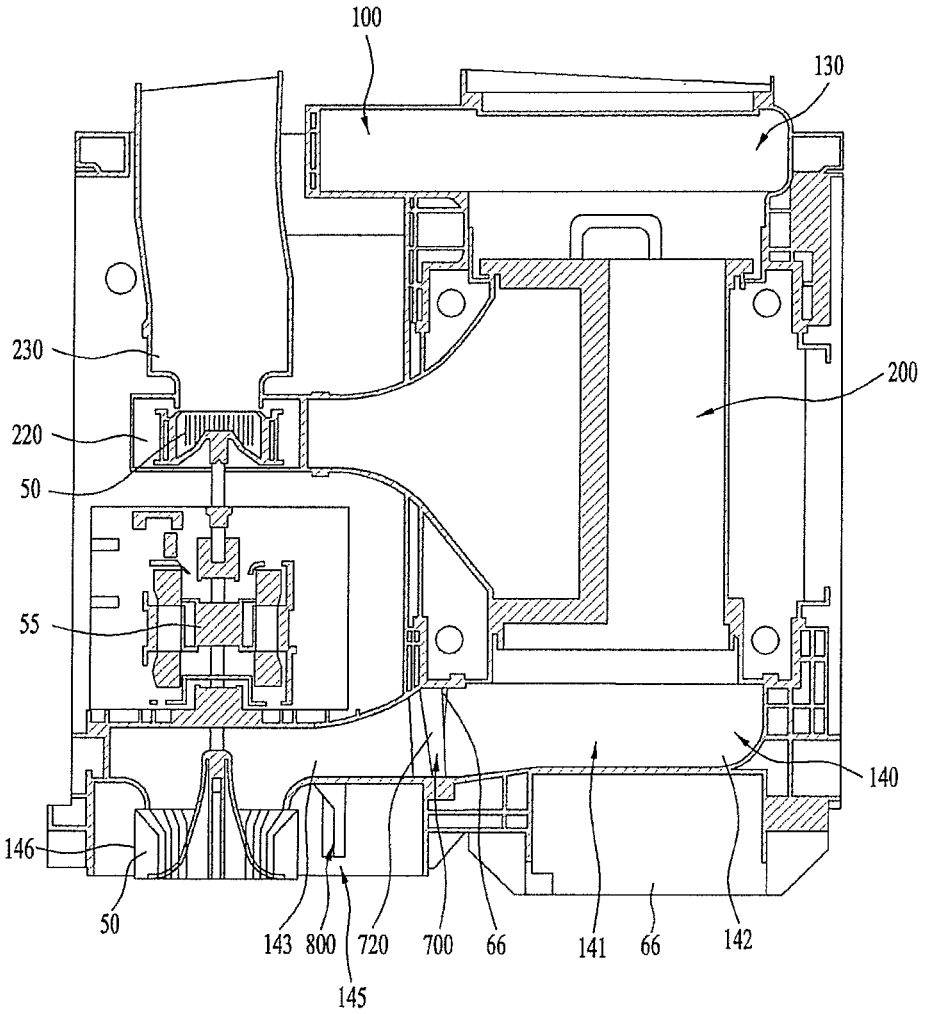
FIG. 12 is a plan cross-sectional view of a base that includes a condensed water-discharging structure of a drying machine according to an embodiment and associated peripheral components.

As shown in FIG. 12, the condensed water-discharging structure according to this embodiment may be applied to the heater-type drying machine including the above-described common base. Descriptions of common components have been omitted.

The drying duct 140 may include a first drying duct 141 and a second drying duct 145. When the first drying duct 141 is positioned between the condensation duct 200 and the second drying duct 145, the second drying duct 145 may be positioned between the first drying duct 141 and the drum 10.

The first drying duct 141 may be connected between a rear end of the condensation duct 200 and a drying fan housing 146 that accommodates the drying fan. Accordingly, the first drying duct 141 may include a condensation duct connector 142 that connects to the condensation duct 200 and a drying fan housing connector 143 that connects to the drying fan housing 146.

The first drying duct 141 may extend horizontally to the drying fan housing 146 from the condensation duct 130 in a lower portion of the drying machine. The first drying duct 141 may be provided behind the base 100 and may be integrally formed with the base 100.

As the drying fan 50 operates, the drying fan 50 may draw in air. Due to suction pressure, condensed water as well as circulating air may flow into the first drying duct 141 from the condensation duct 130. The condensed water may also flow into the drying fan housing 146.

The condensed water-discharging structure 700 may be formed at the first drying duct 141. The condensed water-discharging structure 700 may be provided between the condensation duct connector 142 and the drying fan housing connector 143. For example, the condensed water-discharging structure 700 may be formed at a bottom surface of the first drying duct 141.

The condensed water-discharging structure 700 may include a first drying duct drain outlet 710 formed in a lower portion of the first drying duct 141, and an outer rib 720 provided at a side edge of the first drying duct drain outlet 710. The outer rib 720 may be provided at the side edge of the first drying duct drain outlet 710, which may be close to the drying fan housing 146 so as to extend upward. The outer rib 720 may be provided at the side edge of the first drying duct drain outlet 710, which may be positioned at a rear side in a direction in which air may be introduced. The outer rib 720 may also be inclined upward and forward in the direction in which air may be introduced.

As the suction pressure increases, condensed water that flows along the bottom surface may flow over the first drying duct drain outlet 710. However, condensed water may not flow over the first drying duct drain outlet 710 due to the outer rib 720. That is, condensed water may collide with the outer rib 720 and flow into the first drying duct drain outlet 710.

As shown in FIG. 12, the outer rib 720 may be oriented so as to be inclined if viewed in a plan view. This may be to make a surface of the outer rib 720 substantially perpendicular to the direction in which air may flow. The drying fan housing 146 may be spaced apart from the condensation duct 200 in the anteroposterior direction. Accordingly, air may flow along an inclined line that connects a center of the condensation duct connector 141 with a center of the drying fan housing connector 143. Thus, the outer rib 720 may be inclined to be substantially perpendicular to the direction in which air may flow.

An angle between the outer rib 720 and the bottom surface of the first drying duct 141 may be within a range of about 25 to about 35 degrees. If the angle exceeds this range, air resistance may be increased. If the angle is more acute than this range, condensed water may flow over the outer rib 720.

Figure 13:
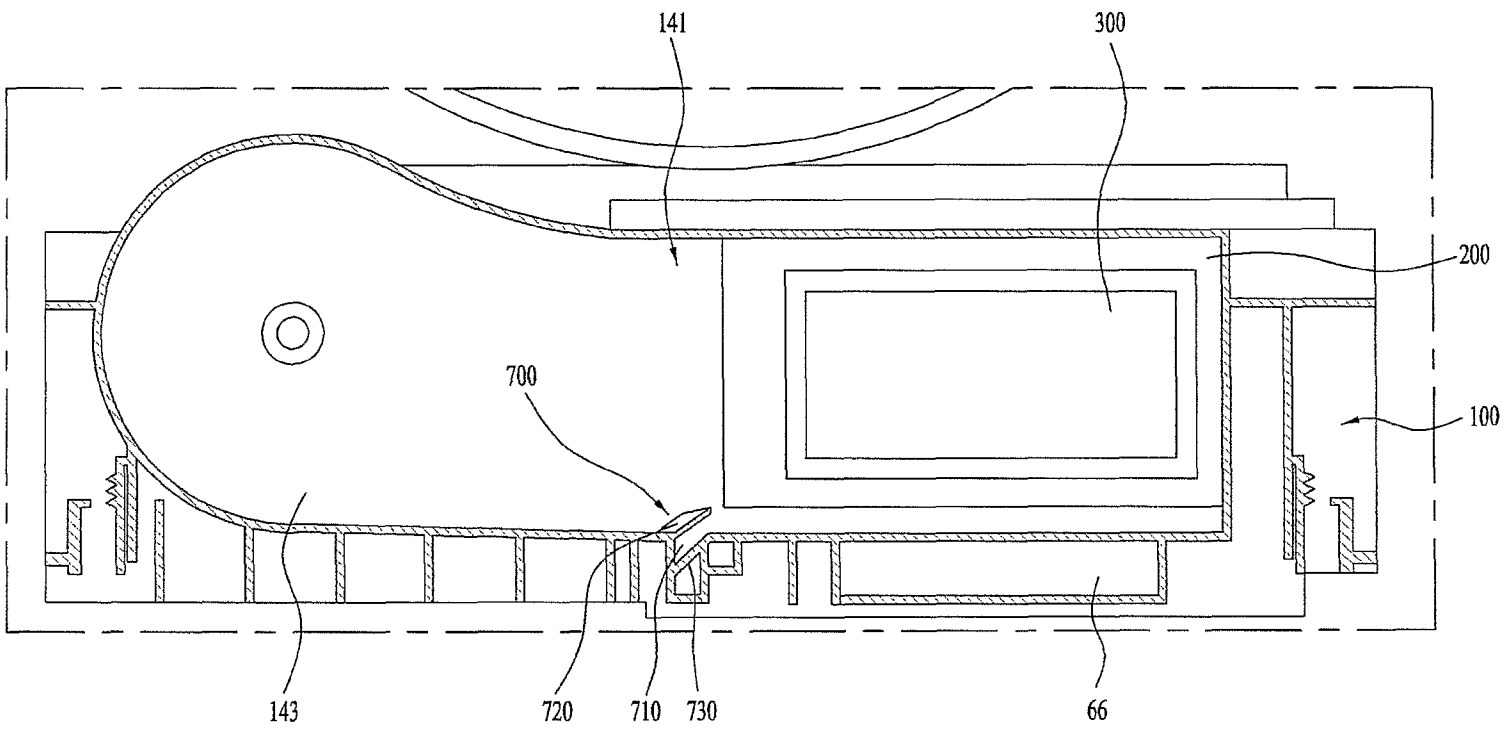
FIG. 13 is a cross-sectional view of the condensed water-discharging structure shown in FIG. 12.
Figure 14:
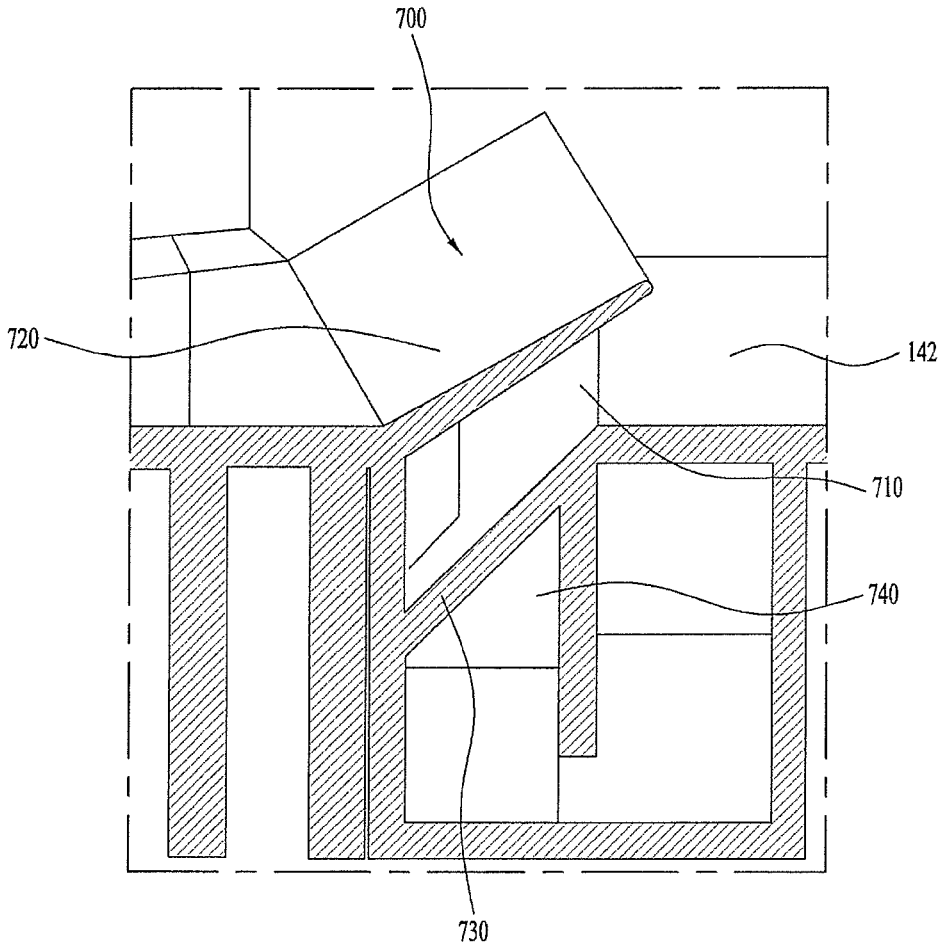
FIG. 14 is an enlarged cross-sectional view of the condensed water-discharging structure shown in FIG. 13.

As shown in FIG. 13, the condensed water-discharging structure 700 may include an inner rib 730, which may be constructed to prevent condensed water from flowing back through the first drying duct drain outlet 710. Accordingly, the inner rib 730 may be provided to extend downwards at the side edge of the first drying duct drain outlet 710, which may be close to the condensation duct 200.

The inner rib 730 may be inclined downward and toward the drying fan housing 146. An angle between the inner rib 730 and the first drying duct 141 may be within a range of about 130 to about 140 degrees.

The outer rib 720 may be positioned at an upper portion of the first drying duct drain outlet 710, whereas the inner rib 730 may be positioned at a lower portion of the first drying duct drain outlet 710. Thus, it may be possible to efficiently prevent condensed water from flowing backwards, while guiding the condensed water into the first drying duct drain outlet 710.

Due to the positional relationship between the front end and the rear end of the first drying duct 141 as described above, a rate of airflow may vary along an anteroposterior width of the first drying duct 141. For example, the rate of airflow may be higher at a front portion of the first drying duct 141 shown in FIG. 12 (that is, the front portion of the drying machine). Thus, a larger amount of condensed water may flow at the front portion of the first drying duct 141 in the anteroposterior direction.

A transverse width of the first drying duct drain outlet 710 may vary along a longitudinal direction. For example, the transverse width at a front end of the first drying duct drain outlet 710 may be greater than the transverse width at a rear end of the first drying duct drain outlet 710. That is, the transverse width at the front end of the first drying duct drain outlet 710, over which condensed water may flow, may be greater than the transverse width at the rear end of the first drying duct drain outlet 710, over which the condensed water may flow.

The first drying duct drain outlet 710 may be formed along an entire anteroposterior length of the first drying duct 141. That is, the first drying duct drain outlet 710 may be formed in a bottom of the first drying duct 141 along the entire anteroposterior length thereof. This may enable a larger amount of condensed water to flow into the first drying duct drain outlet 710.

Condensed water in the drying fan housing connector 143 and condensed water from the condensation duct 200 may need to be allowed to flow into the first drying duct drain outlet 710. This may be because condensed water may be naturally generated in the first drying duct 141 when the drying machine is not operated. Accordingly, there may be a need to provide a structure capable of introducing condensed water present between the first drying duct drain outlet 710 and the drying fan housing connector 143 into the first drying duct drain outlet 710. Thus, the outer rib 720 may be formed along the entire anteroposterior length of the first drying duct 141 excluding a rear portion thereof.

Figure 15:
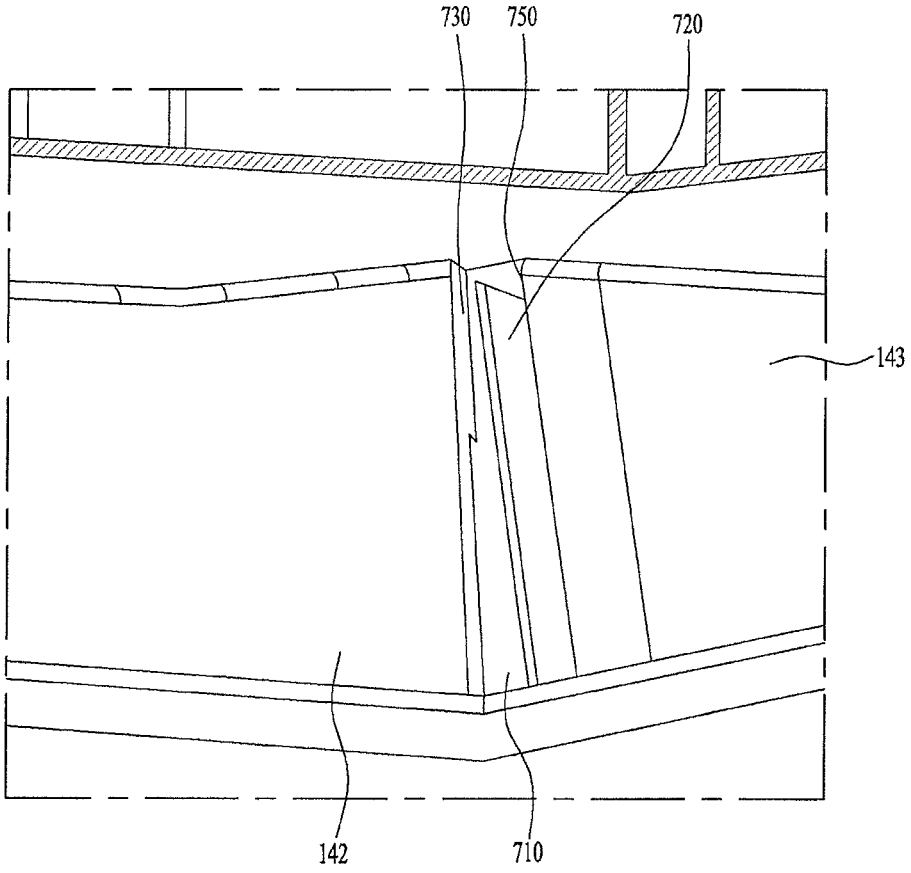
FIG. 15 is an enlarged perspective view of the condensed water-discharging structure shown in FIG. 12.

As shown in FIG. 15, the outer rib 720 may not be formed at a rear portion of the anteroposterior width of the first drying duct 141. Thus, a gap 750, through which condensed water may flow into the first drying duct drain outlet 710, may be defined. As the gap 750 may be formed at an area at which the flow rate of air may be lowest upon the suction of air, an amount of air that flows over the gap 750 may be relatively small. Accordingly, when the suction of air does not occur, condensed water may flow through the gap 750. The drying fan housing connector 143 of the first drying duct 141 may be inclined downward and toward the first drying duct drain outlet 710, thereby offering smooth air discharge.

In contrast to the outer rib 720, the inner rib 730 may not be formed at a front portion of the anteroposterior length of the first drying duct 141. This may be because a communicating portion 740 may be provided under the inner rib 730. The communicating portion 740 may be connected to the sump 66 through an inner channel. Condensed water, which flows into the first drying duct drain outlet 710, may flow into the sump 66 through the communicating portion 740 and the inner channel.

Accordingly, condensed water in the first drying duct 141 may be efficiently discharged through the condensed water-discharging structure 700 regardless of whether the drying machine is running or shut down. Thus, condensed water may be efficiently prevented from flowing into the drying fan housing 146, the heater 60, and the drum 10.

Figure 16:
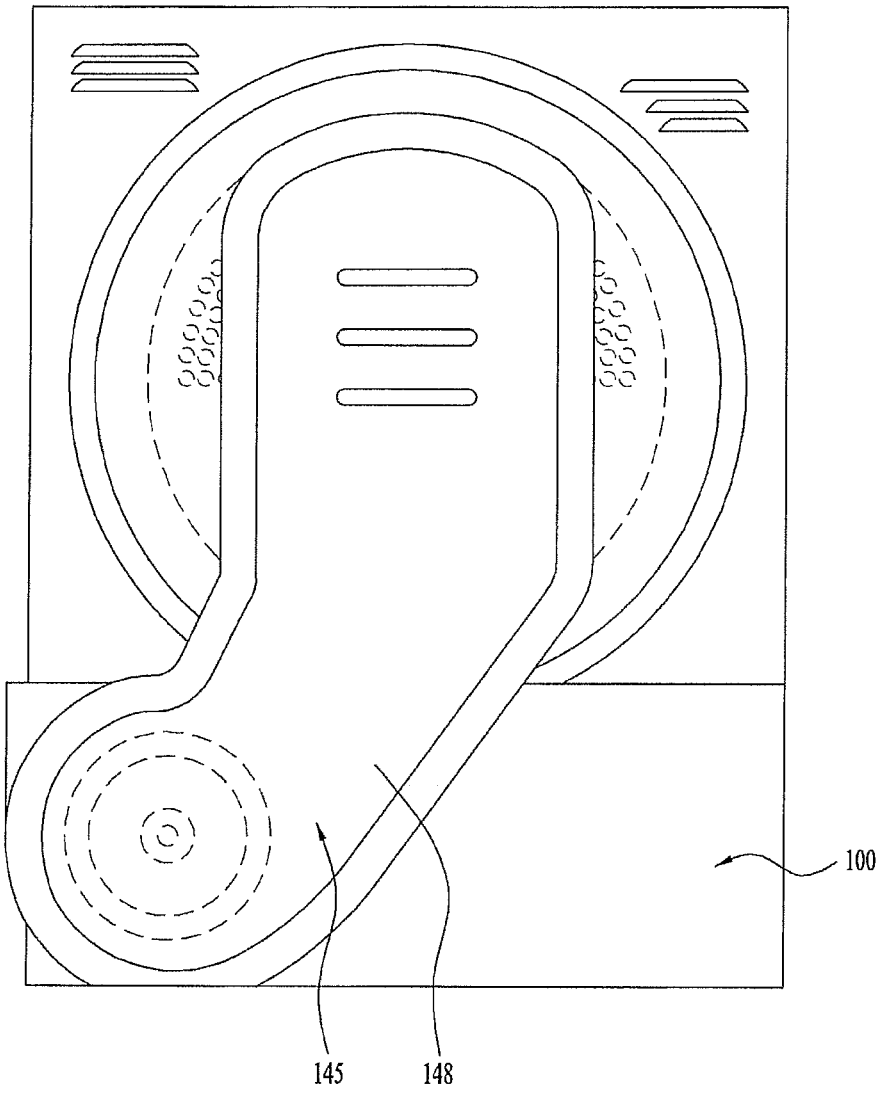
FIG. 16 is a rear view of a back surface of a conventional drying machine.
Figure 17:
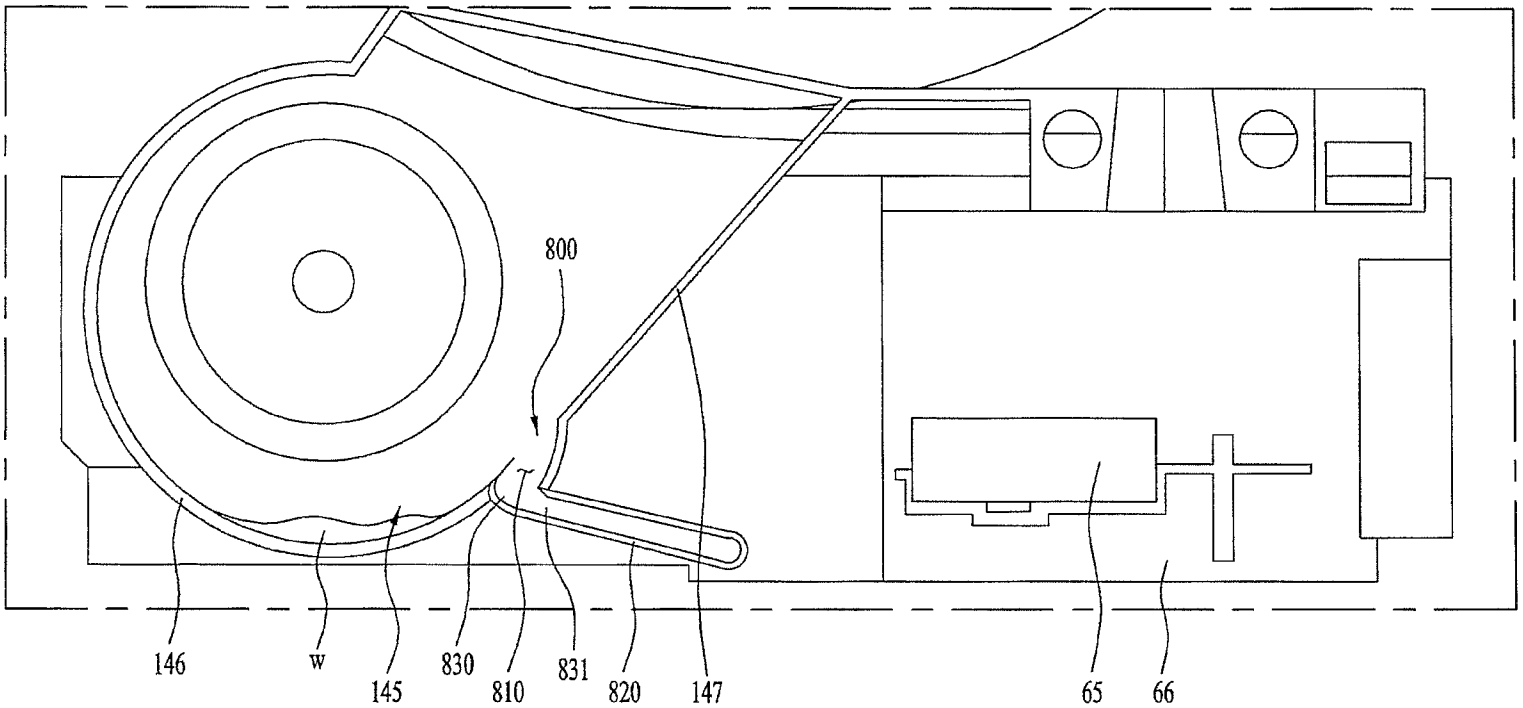
FIG. 17 is a cross-sectional view of a base that includes a condensed water-discharging structure of a drying machine according to another embodiment.
Figure 18:
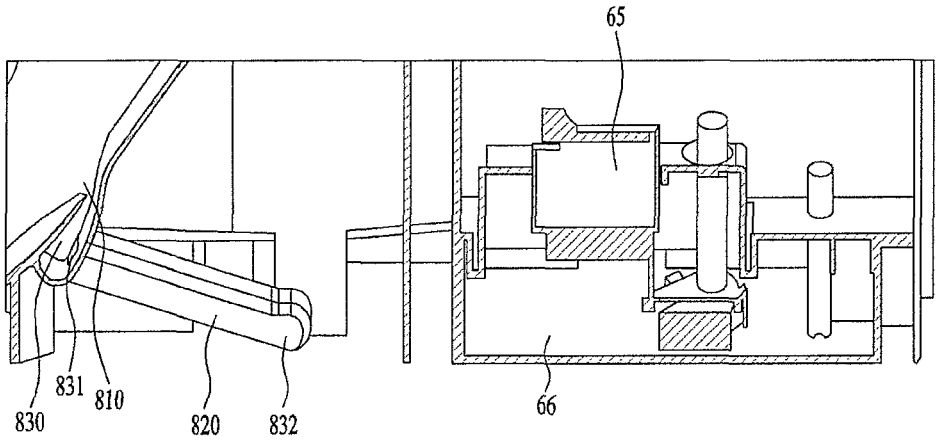
FIG. 18 is a longitudinal cross-sectional view of the condensed water-discharging structure shown in FIG. 17.

Referring to FIGS. 16 to 18, another embodiment of the condensed water-discharging structure is provided. This embodiment may be constructed in conjunction with the above-described condensed water-discharging structure 700. This embodiment may be applied to the common base 100 of the drying machine.

FIG. 16 is a rear view of a back surface of a conventional drying machine. The back surface of the drying machine may be provided with a duct cover 148, which may be connected to drying fan housing 146 at a first end and to drum 10 at a second end. Accordingly, the duct cover 148 may form a portion of the second drying duct 145.

FIG. 17 is a cross-sectional view of a base that includes a condensed water-discharging structure of a drying machine according to another embodiment. That is, FIG. 17 illustrates a portion of the second drying duct 145 formed at the base 100 from which the duct cover 148 is removed. The drying fan housing 146 may have a circular shape and may be provided at a lowest position of the second drying duct 145. Condensed water may be collected in the lowest portion of the drying fan housing 146. The duct cover 148 may be provided at a rearmost position of the drying machine and may be in contact with external air. Accordingly, the duct cover 148 may be a component that decreases in temperature soonest when the drying machine is shut down. Thus, a large amount of condensed water may be generated in the duct cover 148 and collected in the drying fan housing 146.

As the drying fan 55 operates, the condensed water may collect along the second drying duct 145. The condensed water may flow into the heater 60. A drain outlet may be provided at the lowermost position of the drying fan housing 146. That is, condensed water may be discharged by providing the drain outlet at a position at which the condensed water may be collected. However, a difference between the lowermost portion of the drying fan housing 146 and the bottom surface of the base 100 may not be great, thereby making it difficult to ensure a natural discharge of condensed water caused by a difference in hydraulic head pressure. Even if the natural discharge of condensed water is allowed, this may incur a greater risk of back-flow of condensed water due to the natural discharge.

Thus, condensed water-discharging structure 800 according to this embodiment may be constructed such that a second drying duct drain outlet 810 may be provided at a side surface of the drying fan housing 146, rather than at the lowermost position thereof.

The second drying duct drain outlet 810 may be provided in an inner inclined surface 147 of the drying fan housing 146, which may be inclined upward and toward the drum from a lowermost inner surface. That is, the second drying duct drain outlet 810 may be higher than the lowermost portion of the drying fan housing 146.

As the drying fan operates, the condensed water w shown in FIG. 17 may collect along the inner surface of the drying fan housing 146. The collecting condensed water may then flow into the second drying duct drain outlet 810. Condensed water generated when the drying machine is shut down may flow downward and may be introduced into the second drying duct drain outlet 810.

For example, the second drying duct drain outlet 810 may be formed between the inner surface of the drying fan housing and the inner inclined surface of the second drying duct in a continuous fashion. The lower and inner surface of the second drying duct may extend further downward at the second drying duct drain outlet 810 and may be connected to the outer surface of the drying fan housing 146 to provide a second drying duct drain pocket 830. The drain pocket 830 may be a space in which condensed water that has flowed into the drain outlet 810 may be temporarily stored.

The drain pocket 830 may be provided with a communicating hole 831. The communicating hole 831 may be connected to a drain connecting channel 820. The drain connecting channel 820 may in turn be connected to the sump 66 through a sump connector 832. Thus, condensed water that has flowed into the drain outlet 810 may flow into the sump 66 through the drain connecting channel 820.

The drain connecting channel 820 may be inclined downward. As the drain connecting channel 820 may be connected to the sump 66, a level of condensed water in the drain connecting channel 820 may be substantially the same as a level of condensed water in the sump 66. Accordingly, by providing the drain outlet 810 at a position higher than the communicating hole 831 in the drain connecting channel 820, the condensed water may be more efficiently discharged. That is, by providing the drain outlet 810 at a position higher than an allowable maximum level of condensed water in the sump 66, condensed water may be more efficiently discharged.

According to embodiments disclosed herein, a drying machine that may include a base adapted to be used in common regardless of a type of drying machine may be provided. Further, a drying machine according to embodiments disclosed herein, which may reduce, by virtue of the common base, a number of components which would otherwise be increased due to application to different types of drying machines may be provided, thereby facilitating manufacture and subsequent management thereof. Furthermore, a drying machine according to embodiments disclosed herein, in which an air circulating device formed at or on a base may have a same channel structure regardless of a type of drying machine, by virtue of adoption of a common base, may be provided.

Also, a drying machine, which may be constructed such that only additional components required for variation of a flow channel due to a change in the type of drying machine may be coupled to a base, may be provided, thereby minimizing a number of parts or components of the drying machine to be managed. A drying machine according to embodiments disclosed herein, which may be constructed to have a same mounting structure between components exclusive to respective types of drying machines and a base, may be provided, thereby facilitating its manufacture.

Additionally, a drying machine according to embodiments disclosed herein, which may be able to efficiently prevent condensed water from flowing into a drum, a drying fan housing, and a heater, regardless of the type of drying machine, may be provided. A drying machine according to embodiments disclosed herein, which may include a base that has a condensed water-discharging structure, may be provided, thereby efficiently discharging condensed water regardless of the type of drying machine. Thus, it may not be necessary to design the condensed water-discharging structure repeatedly depending on or corresponding to the respective types of drying machines.

A drying machine according to embodiments disclosed herein, which may be able to efficiently remove condensed water introduced into a drying fan housing from a condenser, may also be provided, thereby preventing the condensed water from flowing into a heater. Also, a drying machine according to embodiments disclosed herein, which may be able to efficiently remove condensed water generated in a drying fan housing, may be provided, thereby preventing the condensed water from flowing into a heater.

Embodiments disclosed herein provide a drying machine that may include a drum to contain clothes to be dried, an air circulating unit or device that circulates air through the drum, a motor that drives a drying fan for air circulation, a condenser that condenses moisture in circulating air introduced from the drum, a heating unit or heater that heats the circulating air introduced from the condenser, and a base, which may be disposed or provided under the drum to support the drum, and which may form a lower part or portion of the drying machine. The air circulating device may include a condensation duct, which may be adapted to be changed in structure so as to accommodate different types of condensers in accordance with a manner in which the respective condensers perform heat exchange. The base may include a condensation duct mount having a consistent shape and size capable of accommodating any type of condensation duct regardless of the shape of the condensation duct.

Thus, by virtue of the base including the condensation duct mount, it may be possible to use the same base in drying machines that perform cooling and heating in different manners. For example, it may be possible to use the same base in both a heater-type drying machine employing an electric heater and a heat pump-type drying machine employing a heat pump system.

The condensation duct may be mounted on the condensation duct mount on both lateral side walls and the lower wall of the condensation duct. The condensation duct may be provided separately from and independently of the base and may be mounted on the condensation duct mount, and the condensation duct mount may be integrally formed with the base. By mounting the condensation duct on the condensation duct mount, a condensation channel, which may be part of the air circulating device, may be defined in the base.

The lateral side walls of the condensation duct may be formed to be perpendicular to a direction in which circulating air flows in the condensation duct.

The condensation duct mount may include a lower mount, on which a lower wall of the condensation duct may be mounted, and side mounts, on which both lateral side walls of the condensation duct may be respectively mounted. The condensation duct mount may be configured to have a regular hexahedral shape or a rectangular parallelepiped shape and may include an upper opening to allow the condensation duct to be mounted on the condensation duct mount from above, a front opening to allow circulating air to be introduced therethrough, a rear opening to allow circulating air to be discharged therethrough, and side openings connected to the upper opening to constitute or form the side mounts.

Due to the structure and shape of the condensation duct mount, the condensation duct may be easily coupled regardless of the type of condensation duct to be mounted on the condensation duct mount, and the work or function of the condensation duct may be efficiently fulfilled. When the condensation duct is mounted on the side mounts, the side openings may be closed by both lateral side walls of the condensation duct. This may be useful if the condensation duct is used in a heat pump-type drying machine.

When the condensation duct is mounted on the side mounts, a cooling channel may be defined by the side openings in the condensation duct mount. This may be useful if the condensation duct is used in a heater-type drying machine.

Each of the side mounts or the side openings may be configured to have an inverted trapezoidal shape having a smaller width at a lower end thereof. In particular, angles between a lower side and both lateral sides of the trapezoidal shape may be the same. The angles between the lower side and both lateral sides of the trapezoidal shape may exceed about 90 degrees, but may be equal to or smaller than about 105 degrees.

By virtue of the trapezoidal shape, it may be very easy to mount the condensation duct from above. As reliability of a coupling between the condensation duct and the condensation duct mount after mounting may be remarkably improved, it may prevent the condensation duct from shaking. In addition, when a cooling channel is defined through at least portions of the side openings, it may ensure that the cooling channel may have a sufficient area. Considering that an anteroposterior length of the condensation duct may be fixed, this may be because a length of a lower side of the side mounts or the side openings may be inevitably decreased if the angle exceeds about 105 degrees.

One of the side wall and the side mount may be provided with a mounting slot, and the other of the side wall and the side mount may be provided with a mounting rib, which may be fitted into the mounting slot. Thus, it may be easy to mount the condensation duct, and coupling between the two may be secured. Due to a sliding coupling structure and the trapezoidal shape of the side mounts, coupling between the condensation duct and the condensation duct mount may be very easily implemented.

A sealing member may be disposed or provided between the mounting slot and the mounting rib. Thus, air and condensed water in the condensation duct may be prevented from leaking outside of the condensation duct. In addition, it may be possible to prevent external air from infiltrating into the condensation duct.

The base may be provided with a motor mount, on which the motor may be mounted, and a drying fan mount, on which the drying fan may be mounted. Each of the motor and the drying fan may be the same, regardless of manners in which the drying machine may be cooled and heated. Accordingly, shapes and positions of the motor mount and the drying fan mount may be consistent regardless of the type of drying machine.

The air circulating device may include a lint duct, which may be integrally formed at a front portion of the base, and the lint duct may be formed in front of the condensation duct mount. The air circulating device may include a drying duct to supply air to the drum, and the drying duct may extend from a rear end of the condensation duct mount and may be integrally formed with the base.

Accordingly, the lint duct and the drying duct may be provided at the base regardless of the type of drying machine. That is, the air circulation device may be formed to have a same configuration regardless of the type of drying machine.

The base may include a selective mount, which may be integrally formed with the base and on which a compressor or a cooling fan mount may be selectively mounted depending on a shape of the condenser. The selective mount may be positioned beside the condensation duct mount in a direction toward a center of the base. If the condenser is constituted or formed by an evaporation heat exchanger of a heat pump, there may be a need for a compressor that compresses refrigerant. If the condenser is constituted or formed by an air-cooling type heat exchanger, there may be a need for a cooling fan. The compressor and the cooling fan may be components exclusive to each other in the drying machine. Accordingly, the selective mount, on which the components may be selectively mounted, may be provided at the common base.

The condenser may be one of a refrigerant heat exchanger that exchanges heat with the circulating air through a refrigerating cycle and an air heat exchanger that exchanges heat between the circulating air and external air. The condensation duct may be constructed such that both lateral side walls thereof, parallel to the direction in which the circulating air flows, may be closed when the refrigerant heat exchanger is accommodated. The condensation duct may be constructed such that both lateral side walls thereof may be opened so as to communicate with a cooling channel through which external air may flow in and out, when the air heat exchanger is accommodated.

The condensation duct mount may include side openings, which may be closed by both lateral side walls of the condensation duct when the condensation duct that accommodates the refrigerant heat exchanger is mounted on the condensation duct mount, and which may be opened so as to communicate with the cooling channel when the condensation duct that accommodates the air heat exchanger is mounted on the condensation duct mount. The side openings may be configured to have an inverted trapezoidal shape.

According to another embodiment disclosed herein, a drying machine for drying items or clothes in a drum by circulating air through the drum may include a condenser, which may be constituted or formed by one of a refrigerant heat exchanger that uses a refrigerating cycle and an air heat exchanger that uses external air so as to condense moisture in circulating air introduced from the drum, a heating unit or heater that heats the circulating air introduced from the condenser, a base, which may be disposed or provided under the drum to support the drum and may constitute or form a lower part or portion of the drying machine, and a condensation duct having an external shape which may be changed depending on a shape of a condenser accommodated therein. The base may include a condensation duct mount, which may be integrally formed with the base and on which the condensation duct may be mounted regardless of the external shape of the condensation duct. Accordingly, the same base may be used in common regardless of the type of drying machine.

The condensation duct mount may have a same shape and size regardless of shapes of the condenser and the condensation duct such that the base may be used in common in drying machines having the same external dimensions. The condensation ducts of the respective drying machines may have to be configured to correspond to the shape and size of the condensation duct mount.

When the type of drying machine is changed, the shape of the condensation duct may also be changed. However, the mounting structure of the condensation duct, which may be required to be mounted on the condensation duct mount, may not need to be changed.

The condensation duct mount may include side mounts, on which both lateral side walls of the condensation duct may be mounted. The side mounts may include side openings, which may be closed by both lateral side walls of the condensation duct accommodating the condenser constituted or formed by the refrigerant heat exchanger, but which may be opened through both lateral side walls of the condensation duct accommodating the condenser constituted or formed by the air heat exchanger so as to communicate with external air.

One selected from among the side wall of the condensation duct and the side mount may be provided with a mounting slot, and the other of the side wall and the side mount may be provided with a mounting rib which may be fitted into the mounting slot. A sealing member may be disposed or provided between the mounting slot and the mounting rib.

The air circulating device may include a lint duct, which may be integrally formed with the base and may be formed in front of the condensation duct mount, and a drying duct, which may be integrally formed with the base and may be formed behind the condensation duct. Each of the lint duct and the condensation duct may have a same shape and size regardless of the shape of the condenser.

According to embodiments disclosed herein, a drying machine may include a condenser, which may condense moisture in circulating air introduced from a drum and which may be constituted or formed by one of a refrigerant heat exchanger using a refrigerating cycle or an air heat exchanger using external air, a condensation duct in which the condenser may be accommodated, in which moisture in the circulating air may be condensed, and which may have a shape that may be changed depending on the shape of the condenser, and a base on which the condensation duct may be mounted and which may constitute or form a lower part or portion of the drying machine. The base may include a condensation duct mount, which may have a same shape and size regardless of shapes of the condenser and condensation duct such that the base may be used in common in drying machines having the same external dimensions.

The condensation duct mount may include side mounts provided on both sides thereof and on which both lateral side walls of the condensation duct may be respectively mounted, and the condensation duct mount may include side openings, which may be closed in a case in which the condensation duct accommodating the refrigerant heat exchanger may be mounted and may be opened in a case in which the condensation duct accommodating the air heat exchanger may be mounted. Each of the side mounts or the side openings may be configured to have an inverted trapezoidal shape.

According to an embodiment, a drying machine may include a base provided with a condensation duct mount on which may be mounted a condensation duct, which may accommodate a condenser that condenses moisture in circulating air. The condensation duct mount may include side openings, which may be closed in a case in which a heat pump-type condensation duct may be mounted and which may be opened so as to define a cooling channel through which external air may flow in and out in a case in which a heater-type condensation duct may be mounted.

The heat pump-type condensation duct may accommodate a refrigerant heat exchanger-type condenser that exchanges heat with the circulating air through a refrigerating cycle. The heater-type condensation duct may accommodate an air heat exchanger-type condenser that exchanges heat between the circulating air and external air.

One of the heat pump-type condensation duct and the heater-type condensation duct may be selectively mounted on the condensation duct mount. That is, the type of condensation duct may be changed depending on the type of drying machine without changing the structure or shape of the condensation duct mount.

According to an embodiment, a drying machine may include a base provided with a condensation duct mount on which may be mounted a condensation duct, which may accommodate a condenser that condenses moisture in circulating air. The condensation duct mount may include side openings, and one of a heat pump-type condensation duct, which may accommodate a refrigerant heat exchanger-type condenser that exchanges heat with the circulating air and a heater-type condensation duct, which may accommodate an air heat exchanger-type condenser that exchanges heat between the circulating air and external air, may be mounted on the condensation duct mount. The side openings may be closed in a case in which the heat pump-type condensation duct may be mounted and may be opened so as to define a cooling channel through which the external air may flow in and out in a case in which the heater-type condensation duct may be mounted.

The base may be integrally provided with a lint duct in front of the condensation duct and a drying duct behind the condensation duct. Accordingly, by mounting the condensation duct on the condensation duct mount, the base may be provided with the lint duct, the condensation duct, and the drying duct, all of which may communicate with one another.

The lint duct, the condensation duct, and the drying duct may be formed to have consistent shapes regardless of the type of drying machine. That is, the type of drying machine may be changed merely by changing the type of condensation duct that may be mounted.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A base of a drying machine configured to selectively accommodate any one of a heat pump-type condensation duct and a heater-type condensation duct, the base comprising:

a heat exchanger mount having a first opening provided at a first end thereof, and a second opening provided at a second end thereof;

an inlet duct that communicates with the first opening; and an exhaust duct that communicates with the second opening;

wherein the heat exchanger mount selectively accommodates any one of the heat pump-type condensation duct and the heater-type condensation duct regardless of a shape of the heat pump-type condensation duct and of a shape of the heater-type condensation duct which are different in heat exchange type, wherein the heat exchanger mount includes side mounts having side openings into which the any one of the heat pump-type condensation duct and the heater-type condensation duct is inserted, wherein the heat pump-type condensation duct includes:

a lower condensation duct mounted on the heat exchanger mount, the lower condensation duct communicating with the inlet duct and the exhaust duct;

an evaporation heat exchanger which is accommodated in the lower condensation duct and provided between the first opening and the second opening; and a condensation heat exchanger which is accommodated in the lower condensation duct and provided between the evaporation heat exchanger and the second opening, wherein the lower condensation duct includes side walls configured to be inserted into the side openings of the side mounts, and wherein the heat pump-type condensation duct exchanges heat between circulating air and a refrigerant, whereas the heater-type condensation duct exchanges heat between circulating air and external air.

2. The base according to claim 1, wherein the inlet duct is integrally formed with the heat exchanger mount.

3. The base according to claim 1, wherein the exhaust duct is integrally formed with the heat exchanger mount and extends from an end of the heat exchanger mount.

4. The base according to claim 1, wherein the heat exchanger mount includes:

a lower mount on which the any one of the heat pump-type condensation duct and the heater-condensation duct is seated;

an upper opening through which the any one of the heat pump-type condensation duct and the heater-type condensation duct is mounted from above the lower mount.

5. The base according to claim 4, wherein at least one of each of the side openings has an inverted trapezoidal shape.

6. The base according to claim 5, the air discharged from a drum of the drying machine flows into the first opening; and the air introduced from the first opening is discharged to the drum through the second opening.

7. The base according to claim 6, wherein the exhaust duct communicates with the drum.

8. A drying machine, comprising:

a drum configured to receive items to be dried;

a base which forms a lower portion of the drying machine and is provided below the drum to support the drum, the base being in communication with the drum;

a drying fan provided in the base to circulate air inside the drum; and a motor provided in the base for driving the drying fan, wherein the base includes:

an inlet duct that communicates with a first opening of a heat exchanger mount and is integrally formed with the heat exchanger mount;

an exhaust duct that communicates with a second opening of the heat exchanger mount and communicates with the drum;

the heat exchanger mount that selectively accommodates any one of a first heat exchanger and a second heat exchanger which are different in heat exchange type, wherein the heat exchanger mount includes:

a lower mount on which the any one of the first heat exchanger and, the second heat exchanger is seated;

side mounts having side openings into which the any one of the first heat exchanger and the second heat exchanger is inserted; and an upper opening through which the any one of the first heat exchanger and the second heat exchanger is mounted from above the lower mount, wherein the heat exchanger mount includes:

the first opening into which the air discharged from the drum flows; and the second opening through which the air introduced from the first opening is discharged to the drum, wherein the second heat exchanger includes:

a first heat exchange duct mounted on the heat exchanger mount, the first heat exchange duct communicating with the inlet duct and the exhaust duct;

an evaporation heat exchanger which is accommodated in the first heat exchange duct and provided between the first opening and the second opening; and a condensation heat exchanger which is accommodated in the first heat exchange duct and provided between the evaporation heat exchanger and the second opening, and wherein the first heat exchange duct includes side walls configured to be inserted into the side openings of the side mounts.

9. The drying machine according to claim 8, wherein at least one of each of the side openings has an inverted trapezoidal shape.

10. The drying machine according to claim 8, wherein the drying machine further includes a heater that heats air exhausted from the exhaust duct, and wherein the first heat exchanger includes:

a second heat exchange duct mounted on the heat exchanger mount, the second heat exchange duct including side walls configured to be inserted into the side openings of the side mounts; and a first condenser which is accommodated in the first heat exchange duct and connects the front opening and the rear opening to exchange heat between external air and air flowing from the front opening to the rear opening.

11. The drying machine according to claim 10, wherein each of the side walls of the second heat exchange duct has an opening through which the external air flows.

12. The drying machine according to claim 10, wherein one of the side walls and the side mounts includes a mounting slot, and another of the side walls and the side mounts includes a mounting rib inserted into the mounting slot.

13. The drying machine according to claim 8, wherein each of the side walls of the first heat exchange duct is configured to close the side openings.

14. The drying machine according to claim 8, wherein one of the side walls or the side mounts includes a mounting slot, and another of the side walls or the side mounts includes a mounting rib inserted into the mounting slot.

15. The drying machine according to claim 8, wherein the first heat exchange duct includes:

a lower duct mounted on the heat exchanger mount and on which the side walls are formed; and an upper duct that covers an upper side of the lower duct.

16. The drying machine according to claim 8, wherein the base further includes a selective mount integrally formed with the base, on which a compressor or a cooling fan mount is selectively mounted, and positioned beside the heat exchanger mount.

* * * * *